US005988641A

United States Patent [19]

Lawrence

[11] Patent Number: 5,988,641

[45] Date of Patent: Nov. 23, 1999

[54] BIBLE GAME

[76] Inventor: Fremont Lawrence, c/o S.L.B.G. #7, Manoel St. Box 197, Castries, St. Lucia, Antigua/Barbuda

[21] Appl. No.: 09/093,288

[22] Filed: Jun. 8, 1998

[51] Int. Cl.[6] ..... A63F 3/00; A63F 9/18

[52] U.S. Cl. ..... 273/249; 273/430

[58] Field of Search ..... 273/249, 243, 273/250, 251, 252, 254, 242, 429–432

[56] References Cited

U.S. PATENT DOCUMENTS

| | | | |
|---|---|---|---|
| 4,121,823 | 10/1978 | McBride | 273/249 |
| 4,201,388 | 5/1980 | Cantelon | 273/251 |
| 5,071,133 | 12/1991 | Smith | 273/248 |
| 5,295,834 | 3/1994 | Saunders | 434/245 |

FOREIGN PATENT DOCUMENTS

| | | | |
|---|---|---|---|
| 2274597 | 8/1994 | United Kingdom | 273/242 |

*Primary Examiner*—Benjamin H. Layno
*Attorney, Agent, or Firm*—Michael I. Kroll

[57] ABSTRACT

A bible game (10) comprising an old testament game board (12), a new testament game board (22), a plurality of player pieces (32) and a chance determining means (34). A plurality of angel cards (36), a plurality of archangel cards (38), a plurality of blessing cards (40), a plurality of penalty cards (42) and a plurality of vision cards (44) are used in the play of the game.

20 Claims, 54 Drawing Sheets

BIBLE GAME

BACKGROUND OF THE INVENTION

1. Field of the Invention

The instant invention relates generally to board games and more specifically it relates to a bible game. The bible game will generate a greater interest in the bible through the use of a board game, which is both fun and educational. The bible game will give parents, teachers and adults the opportunity to discuss events and teachings in the bible with children and young people. It will allow families an opportunity to spend quality time together. It will also, hopefully, enhance the moral and spiritual aspects of family life and society as a whole.

2. Description of the Prior Art

Numerous board games have been provided in prior art that are adapted to utilize chance determining means for playing a winning the game. Entertainment is provided to the players by challenging them, so that they utilize their skill and acumen in playing the game, while at the same time providing an element of chance to add a bit of adventure and luck to the game. Thus, combination of challenge and adventure gives the proper entertainment to the players of the game. While these units may be suitable for the particular purpose to which they address, they would not be as suitable for the purposes of the present invention as heretofore described.

SUMMARY OF THE INVENTION

A primary object of the present invention is to provide a bible game that will overcome the shortcomings of the prior art devices.

Another object is to provide a bible game that will generate a greater interest in the bible through the use of a board game, which is both fun and educational.

An additional object is to provide a bible game that will give parents, teachers and adults the opportunity to discuss events and teachings in the bible with children and young people, while allowing families an opportunity to spend quality time together, so as to hopefully enhance the moral and spiritual aspects of family life and society as a whole.

A further object is to provide a bible game that is simple and easy to use.

A still further object is to provide a bible game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
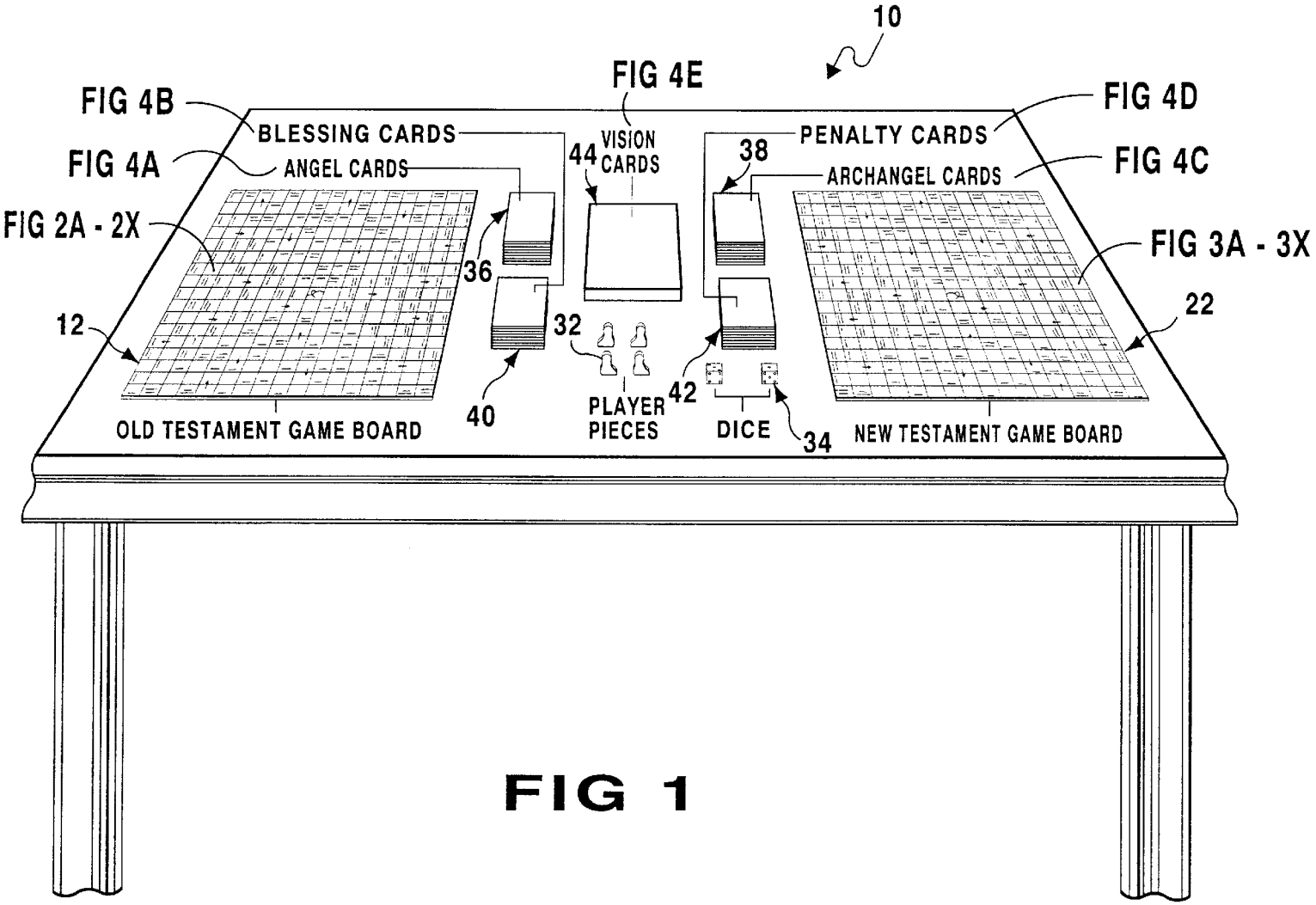
FIG. 1 is a perspective view, showing the various components of the present invention upon a table.
Figure 2:
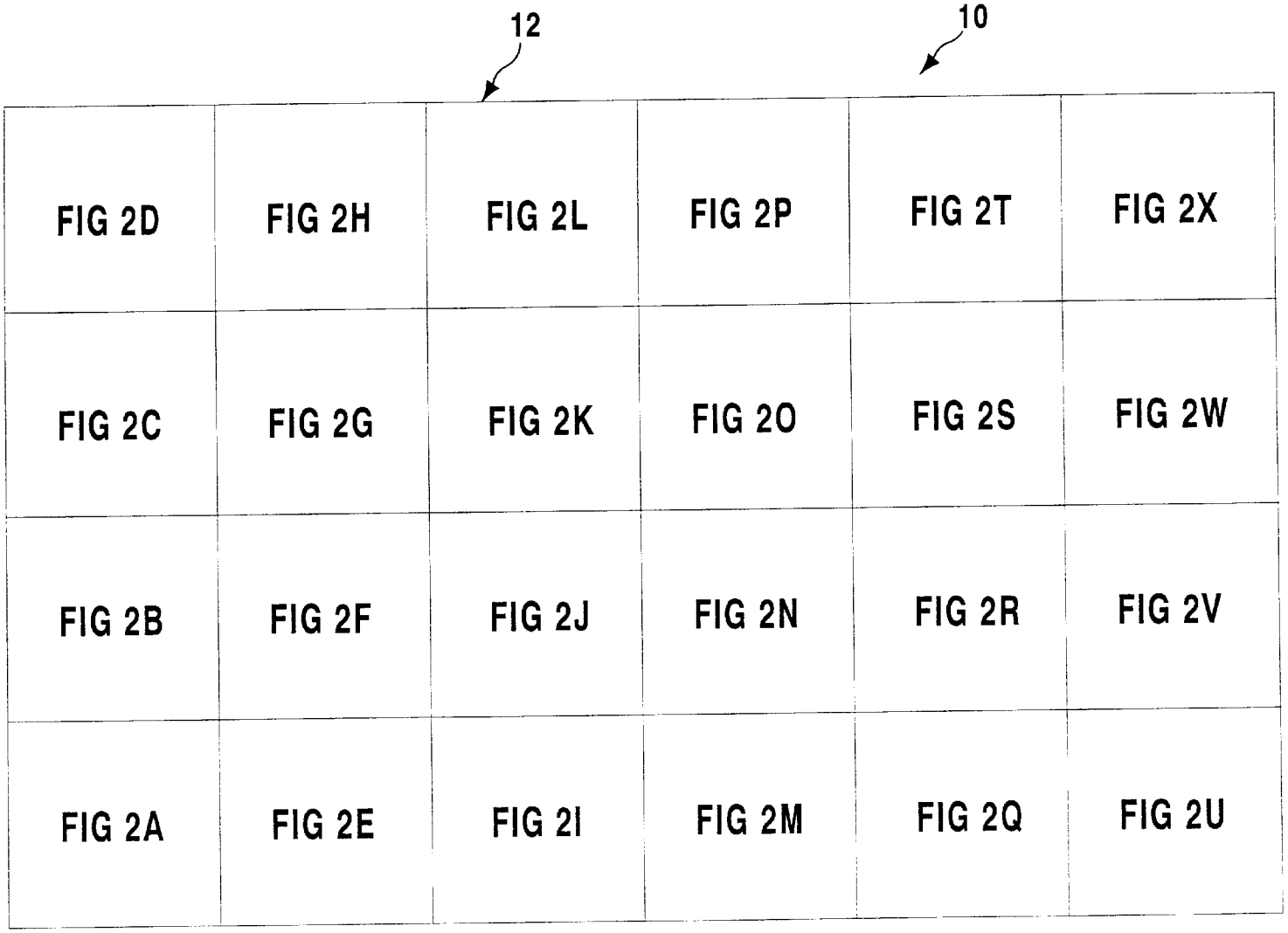
FIG. 2 is a diagrammatic plan view of a grid pattern for the various parts of the old testament game board in FIG. 1.
Figure 2A:
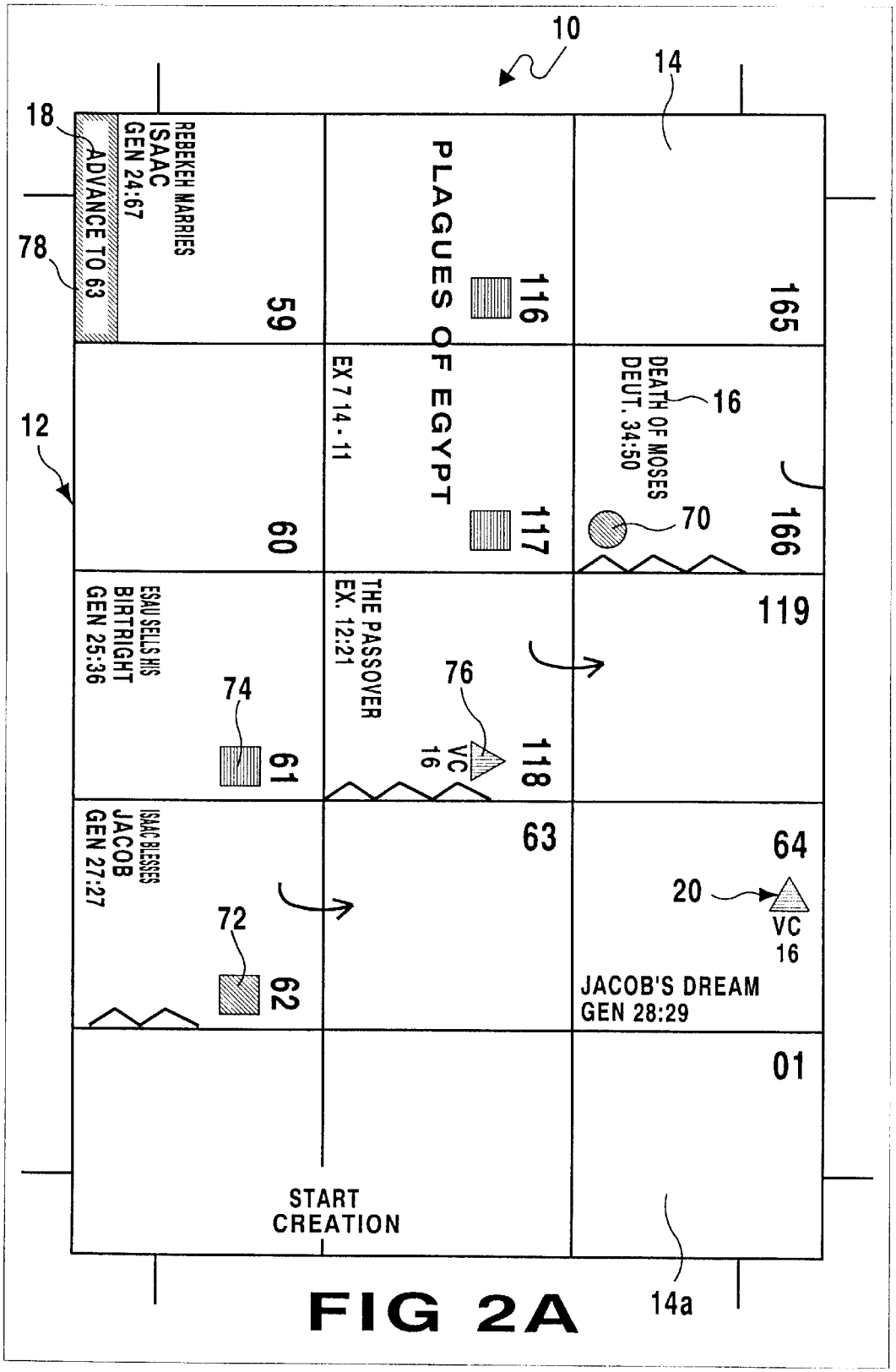
FIG. 2A through 2X are enlarged plan views of the various parts of the old testament game board indicated in FIG. 2.
Figure 2B:
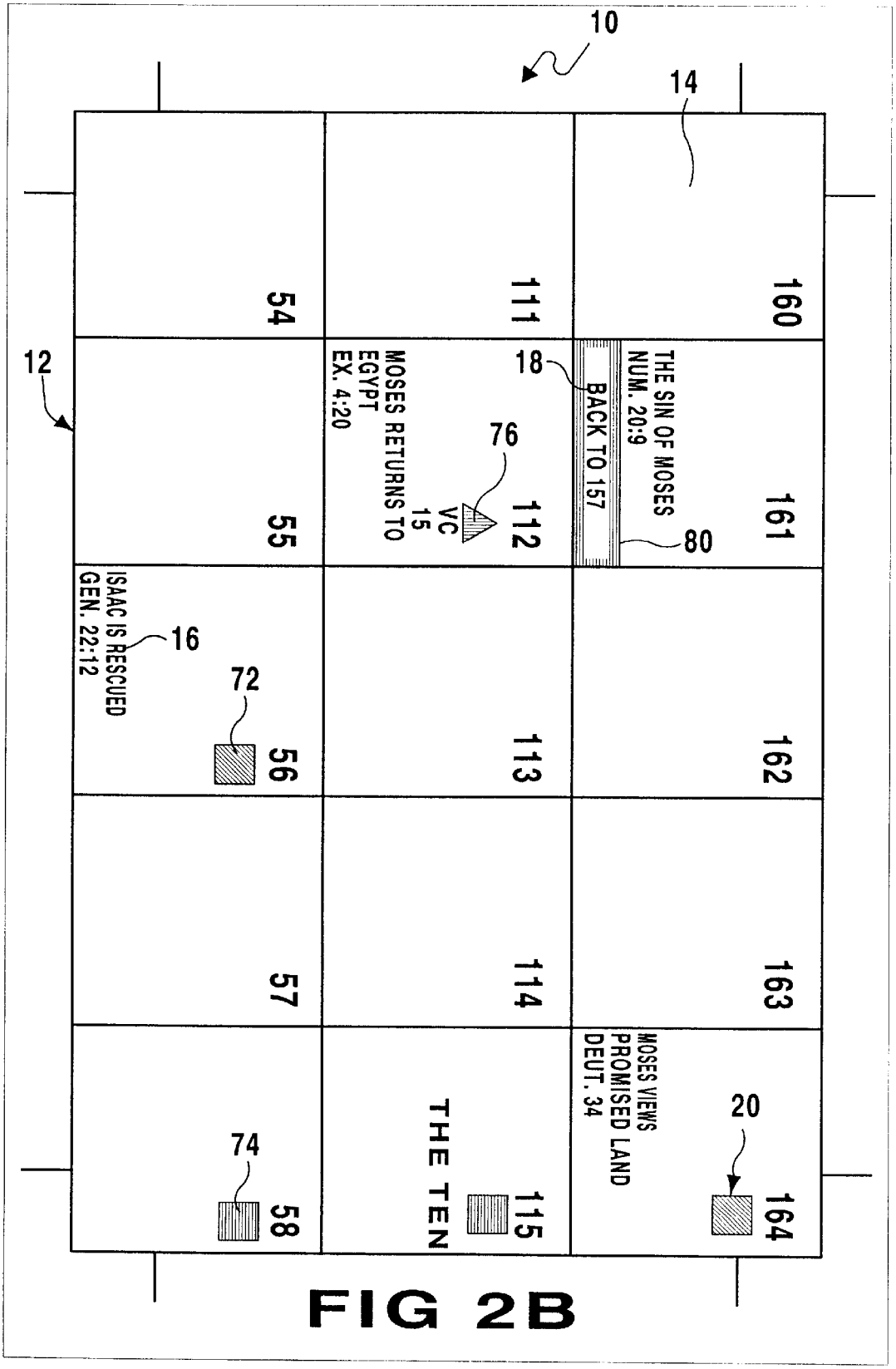
Figure 2C:
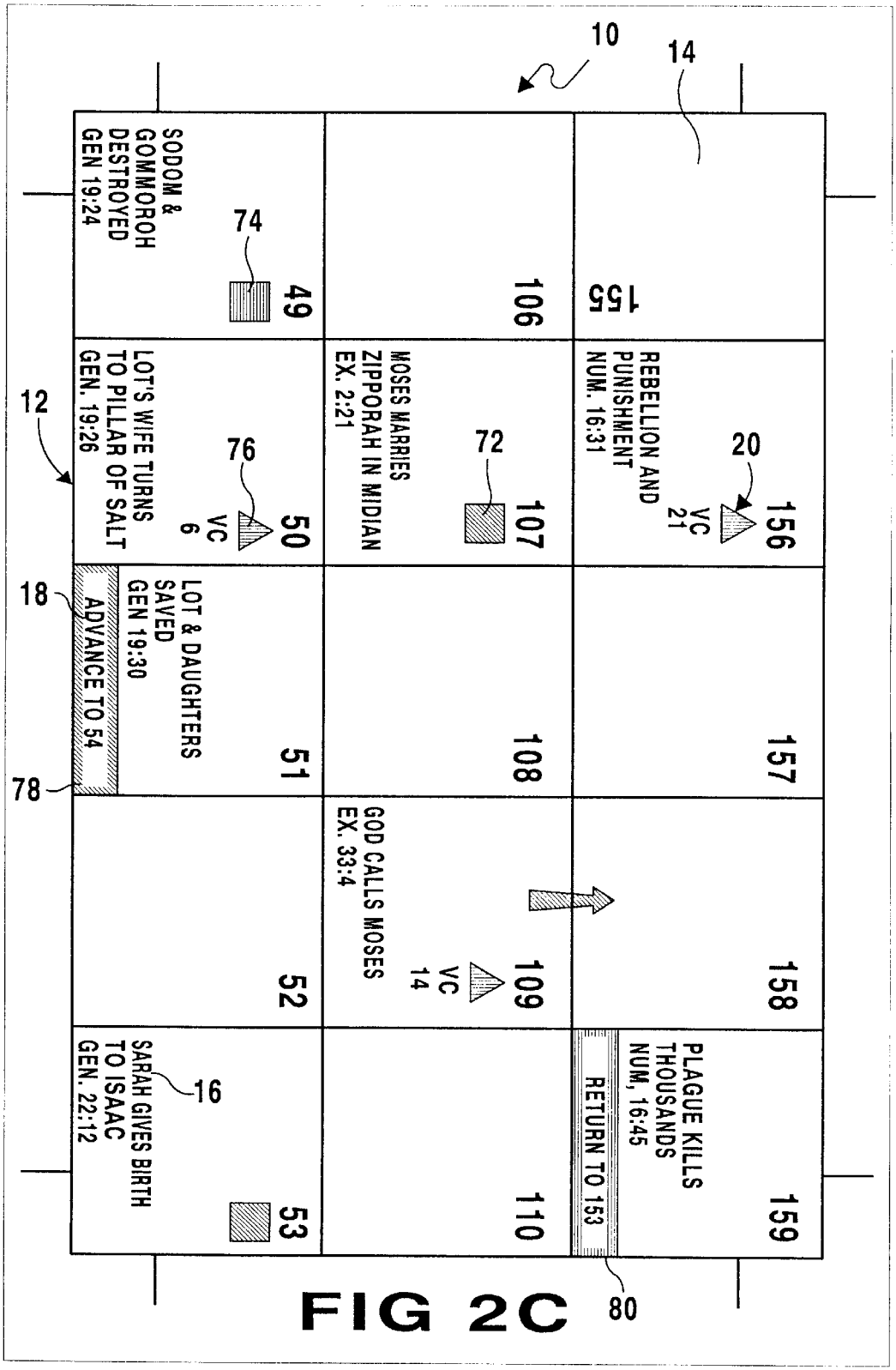
Figure 2D:
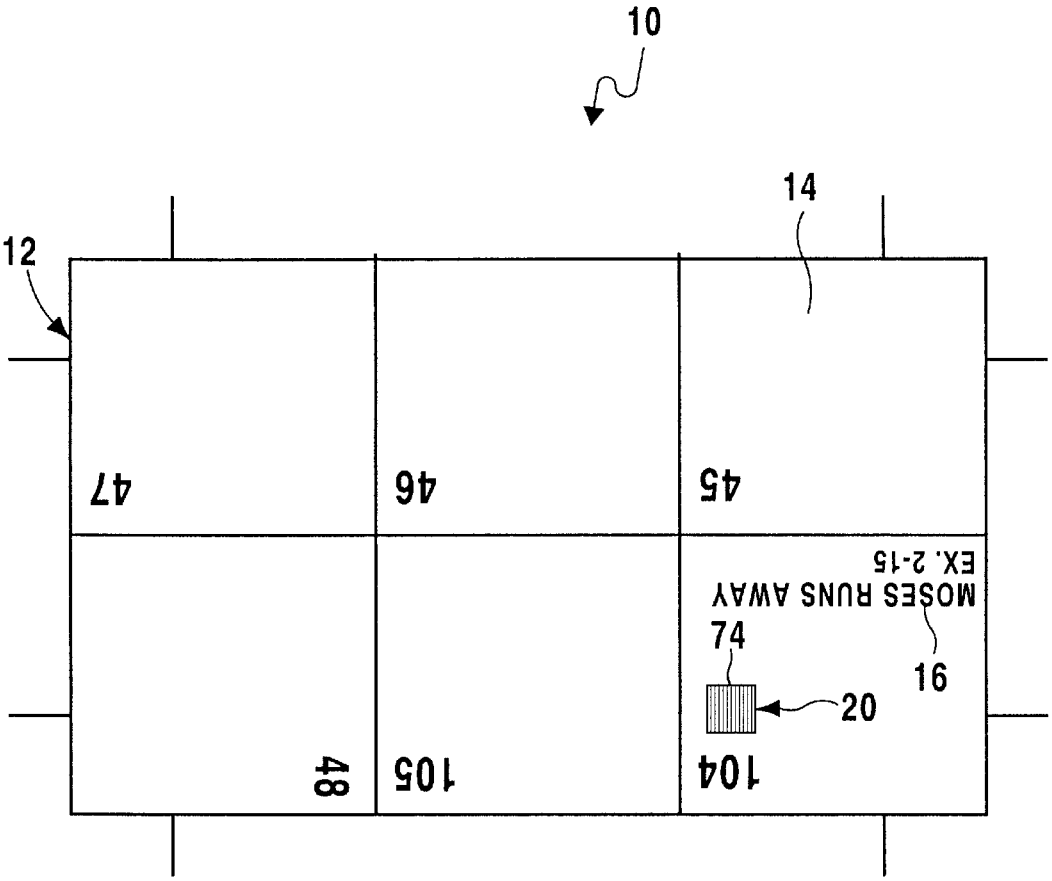
Figure 2E:
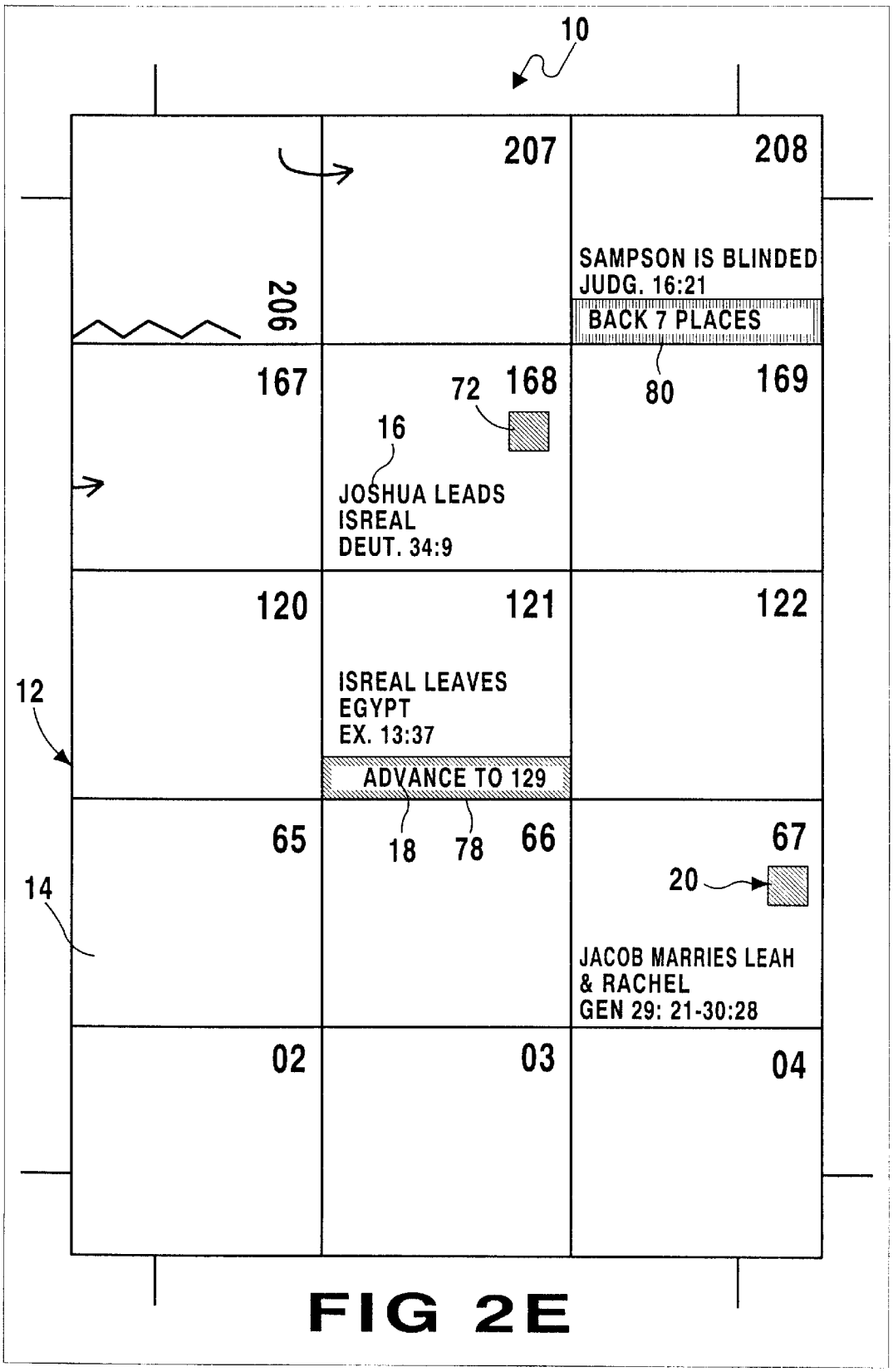
Figure 2F:
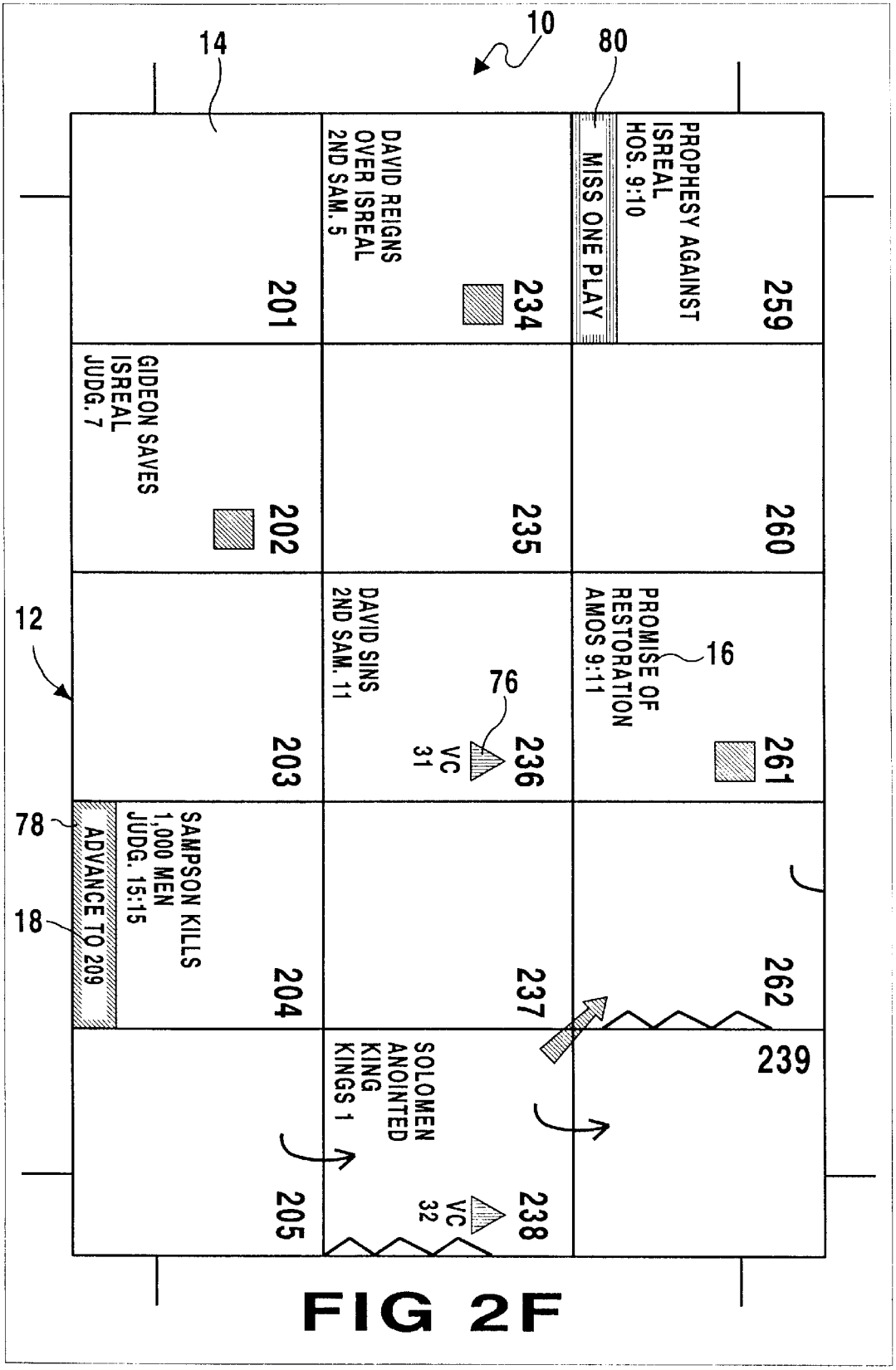
Figure 2G:
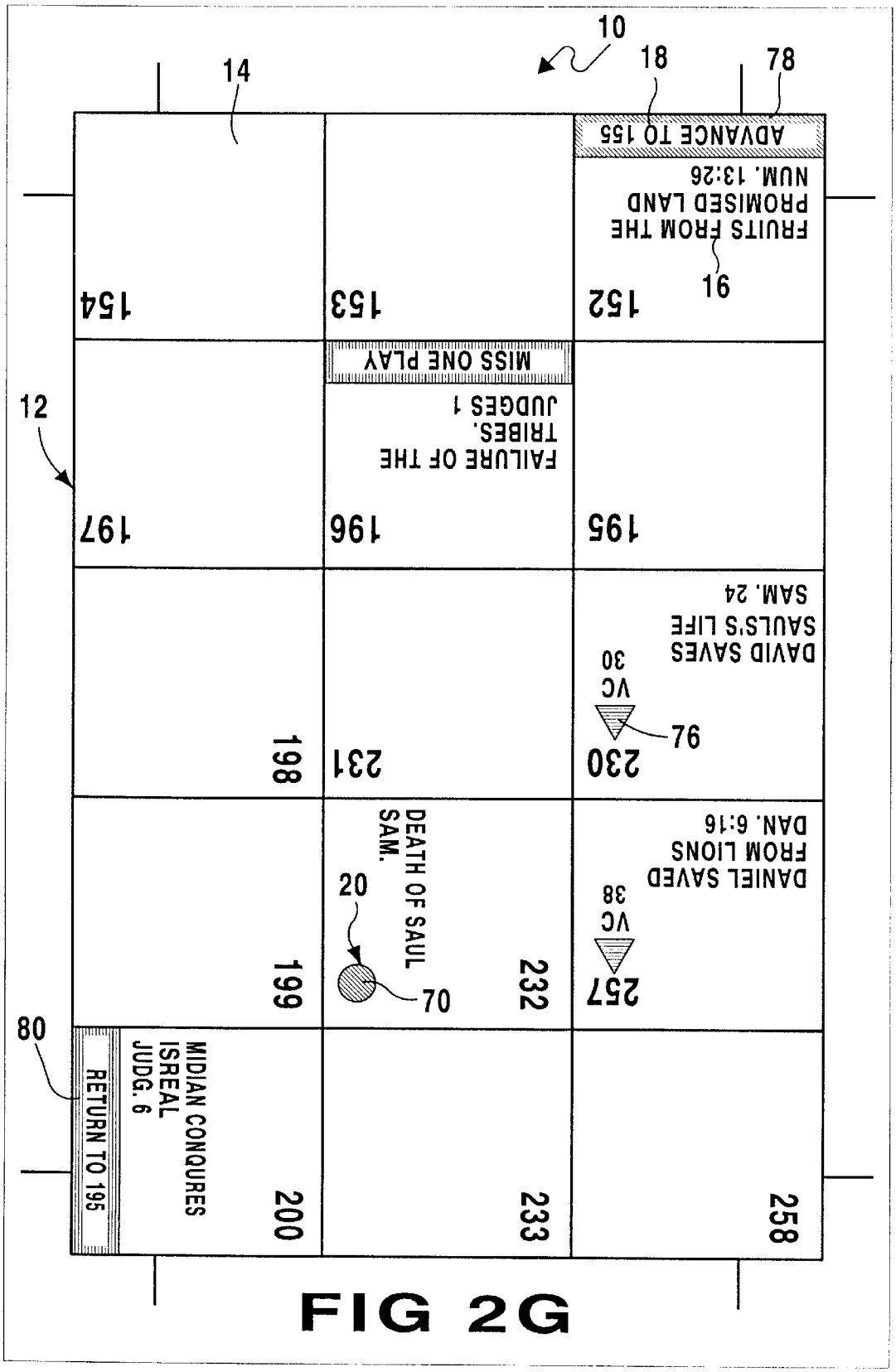
Figure 2H:
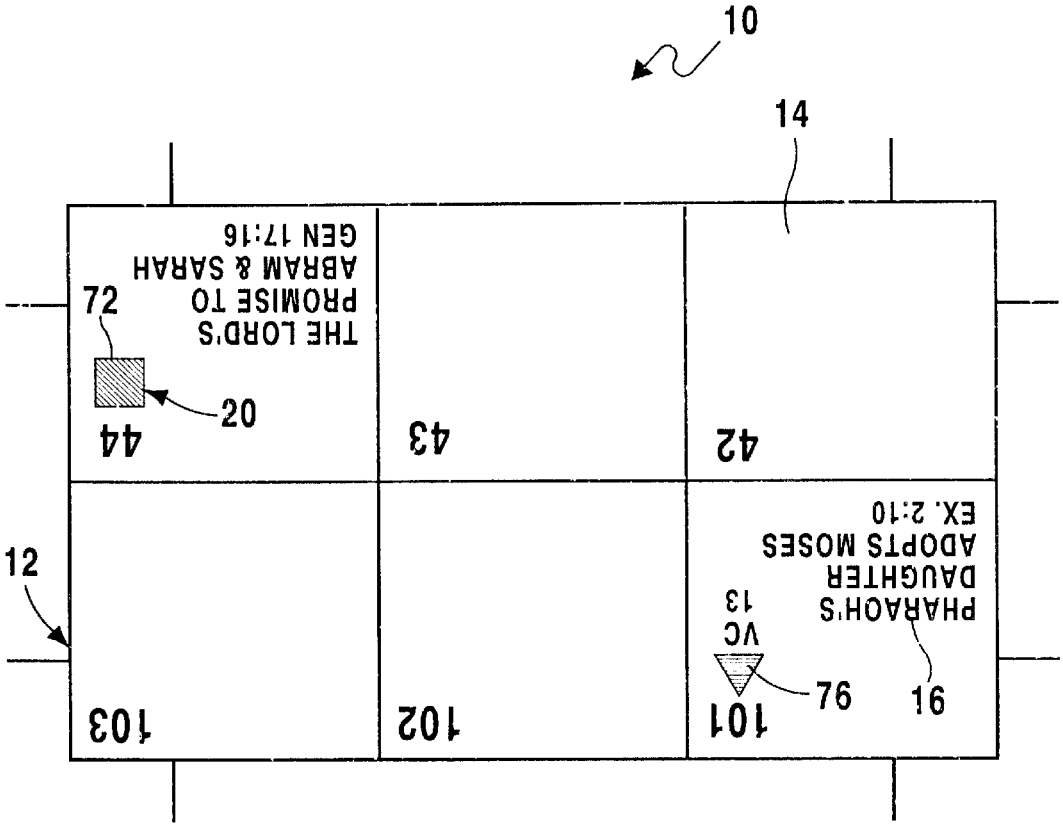
Figure 2I:
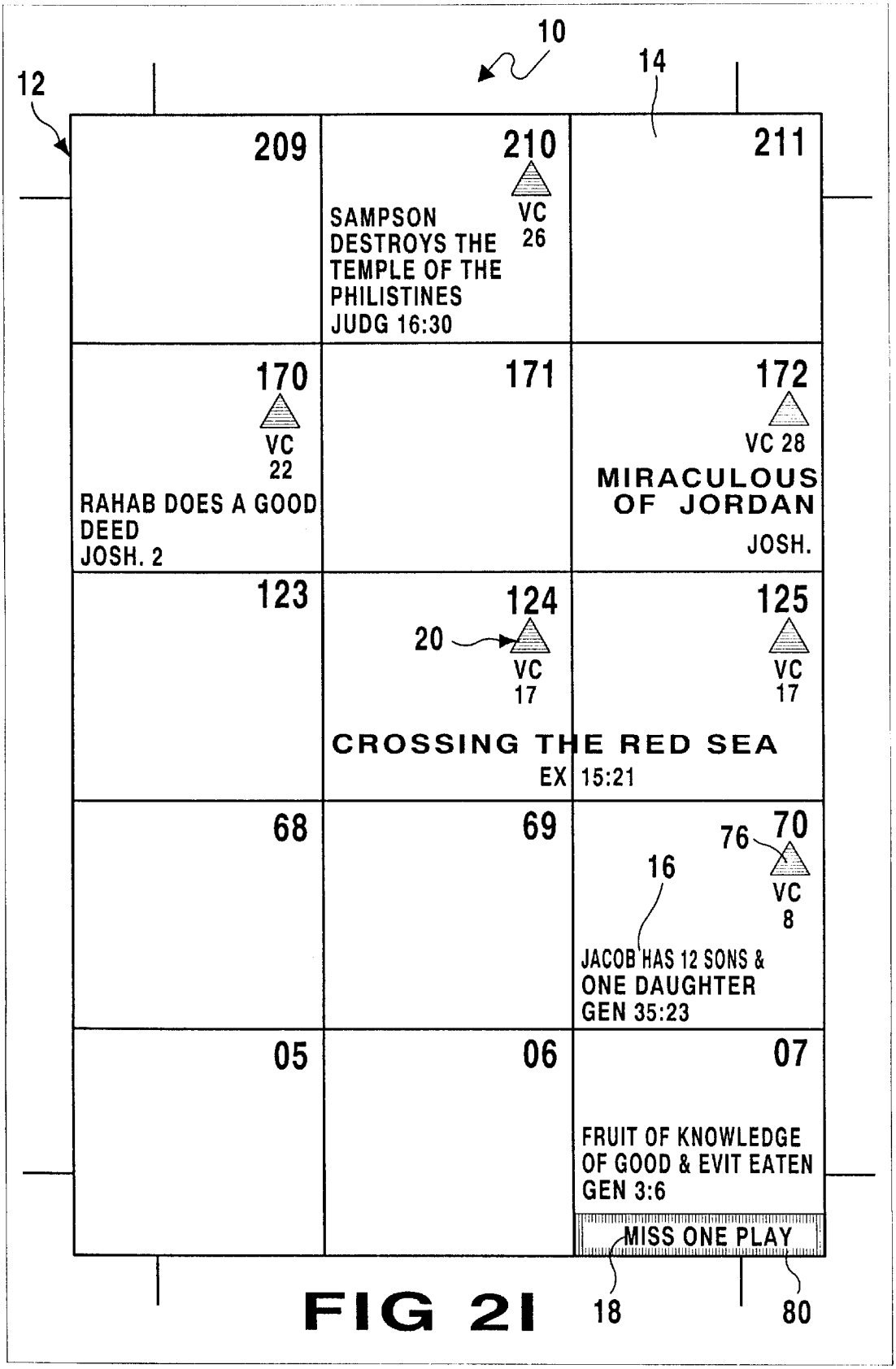
Figure 2J:
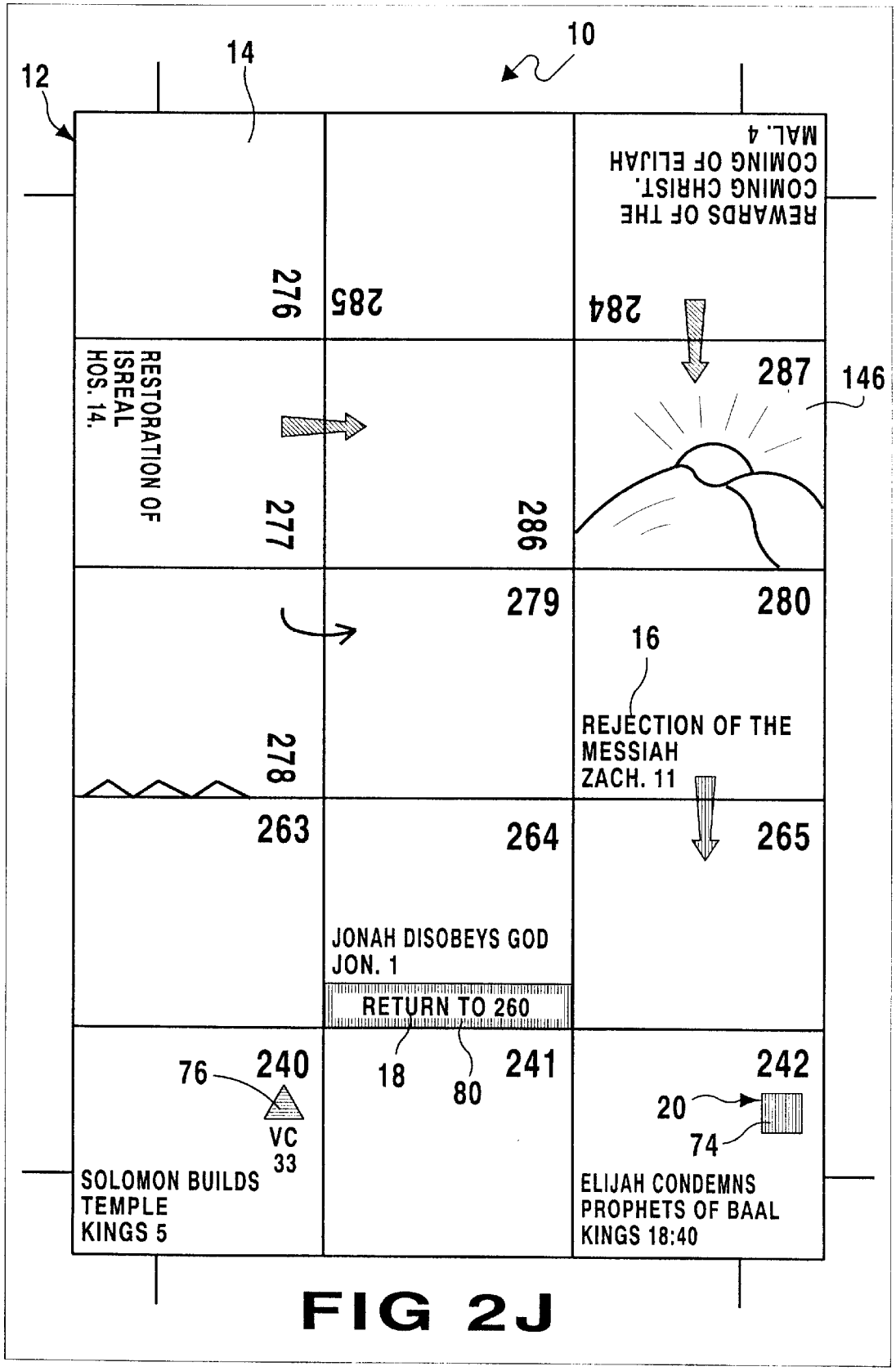
Figure 2K:
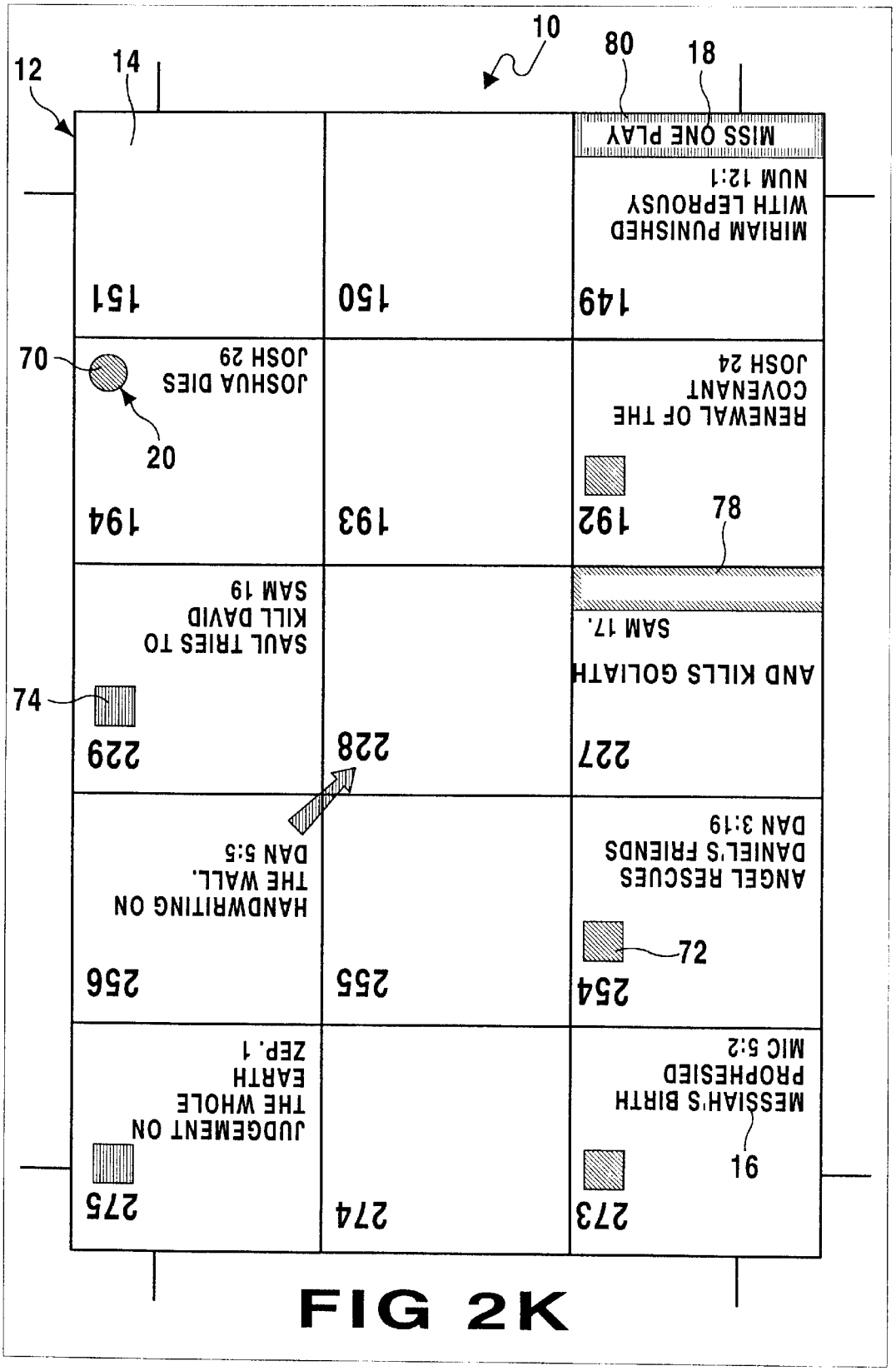
Figure 2L:
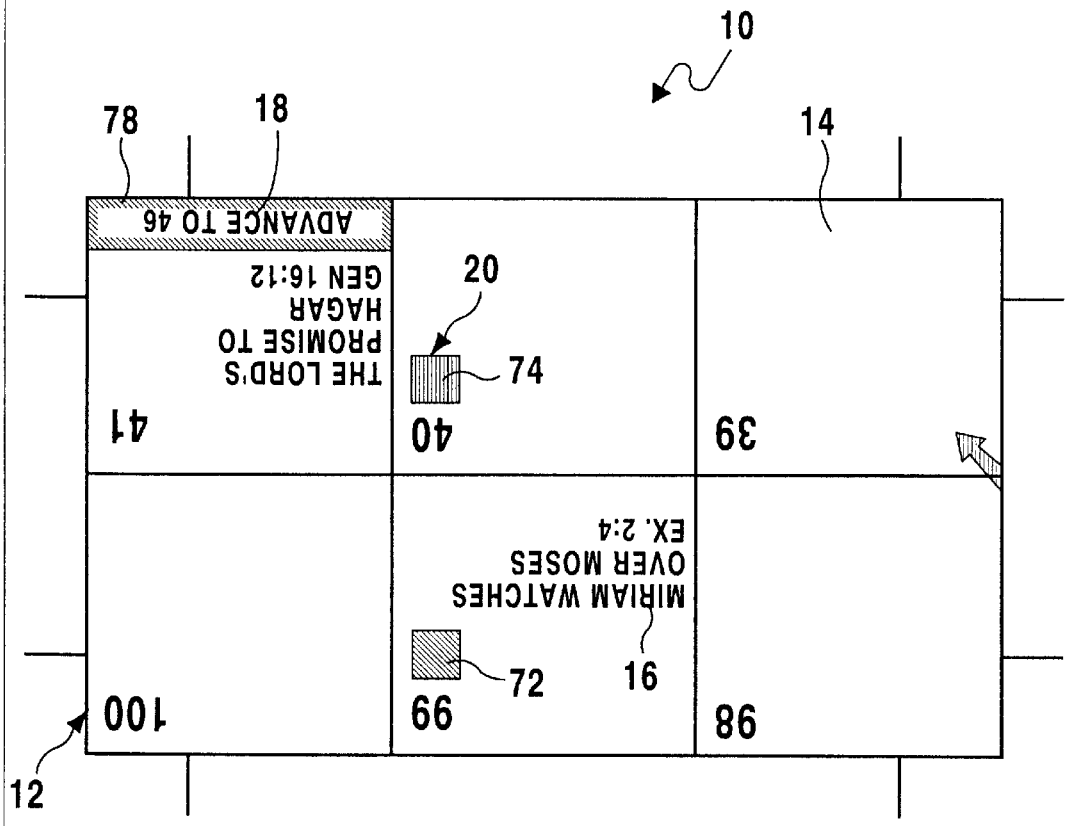
Figure 2M:
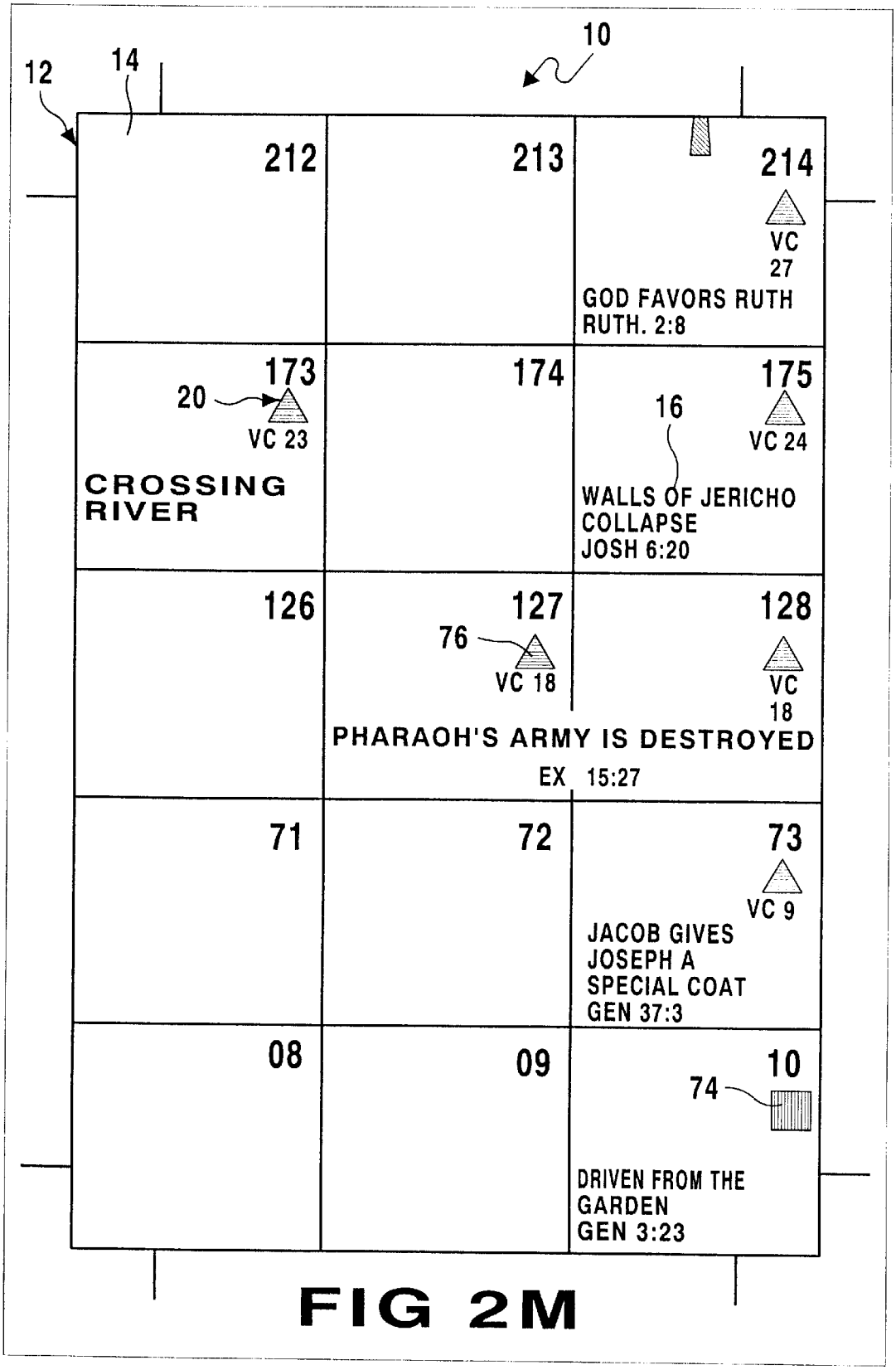
Figure 2N:
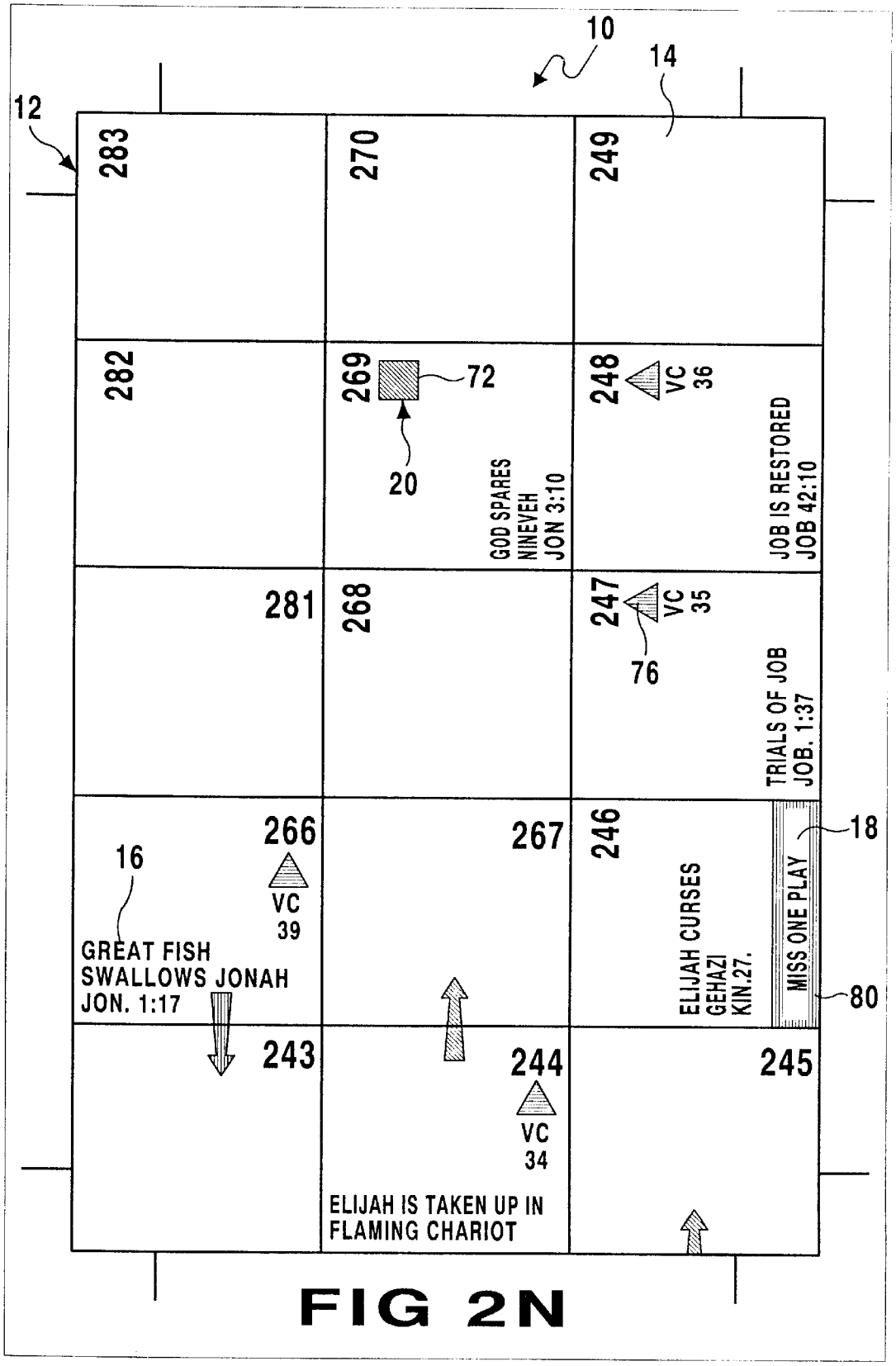
Figure 20:
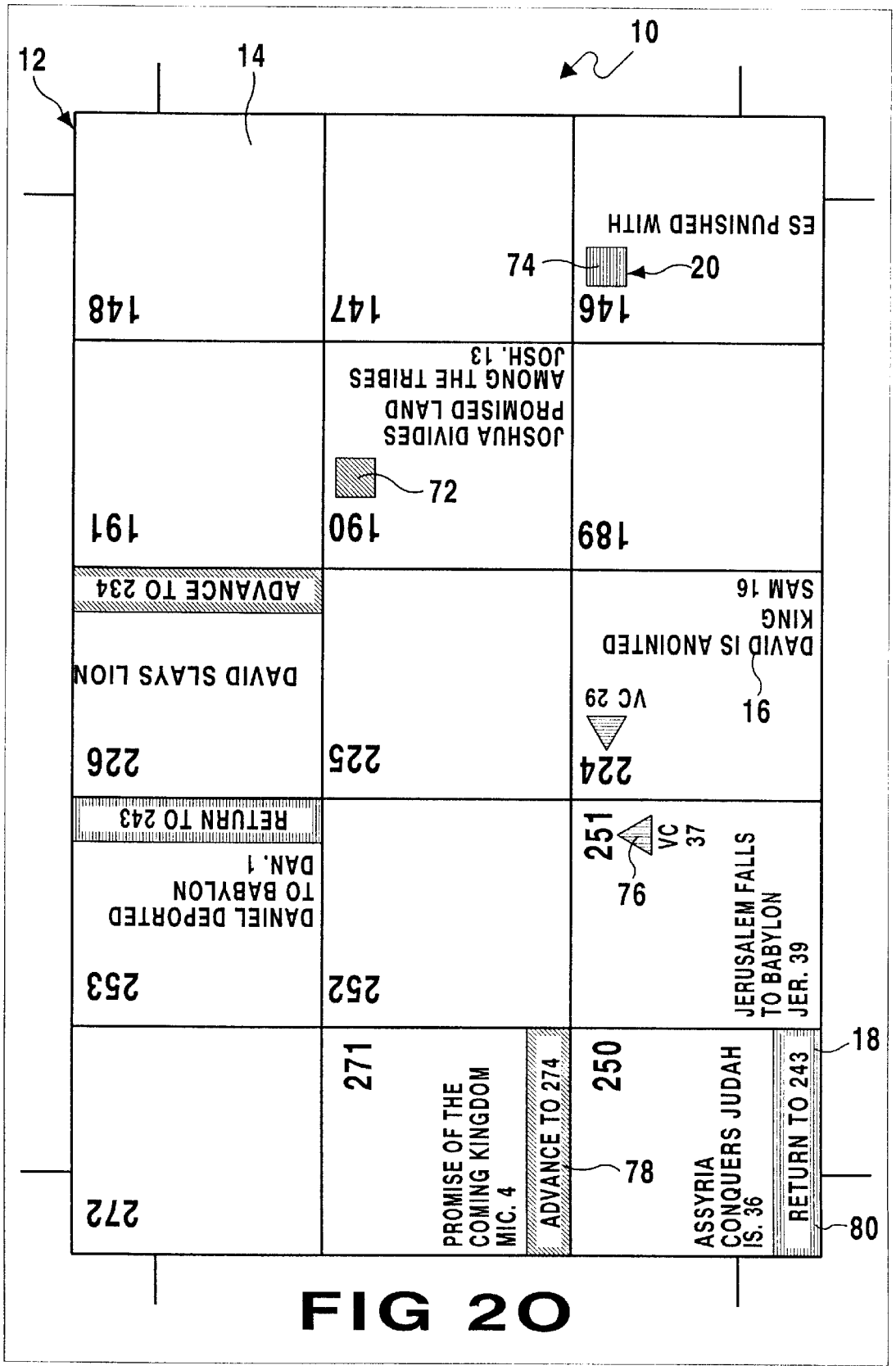
Figure 2P:
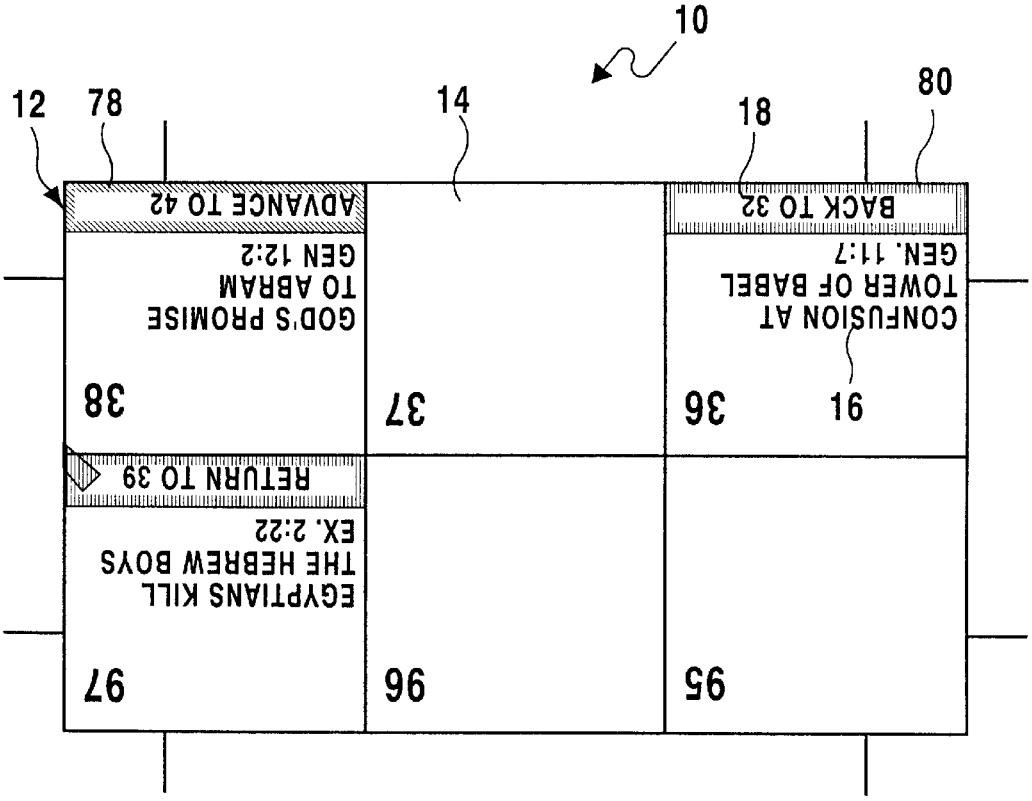
Figure 2Q:
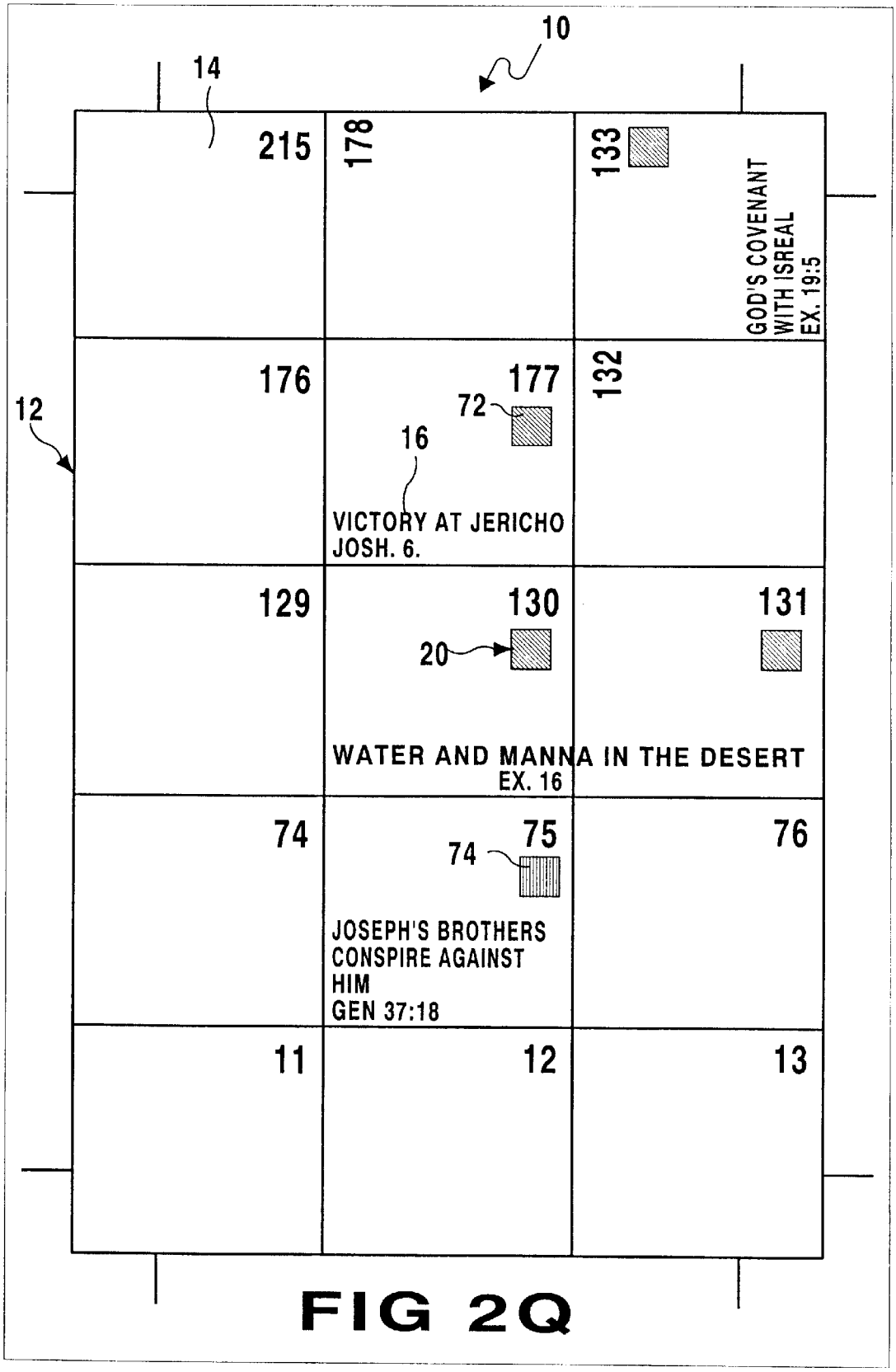
Figure 2R:
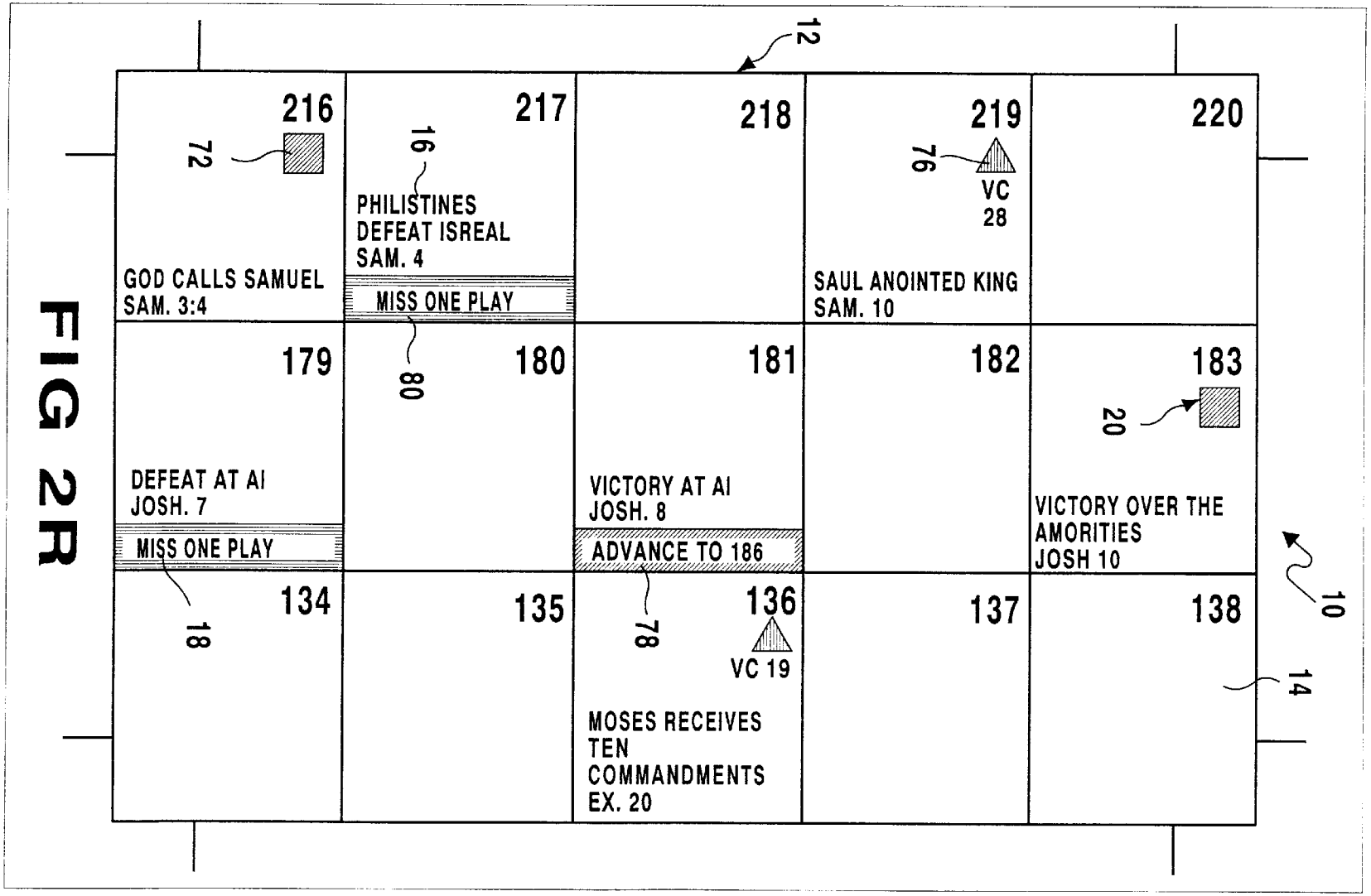
Figure 2S:
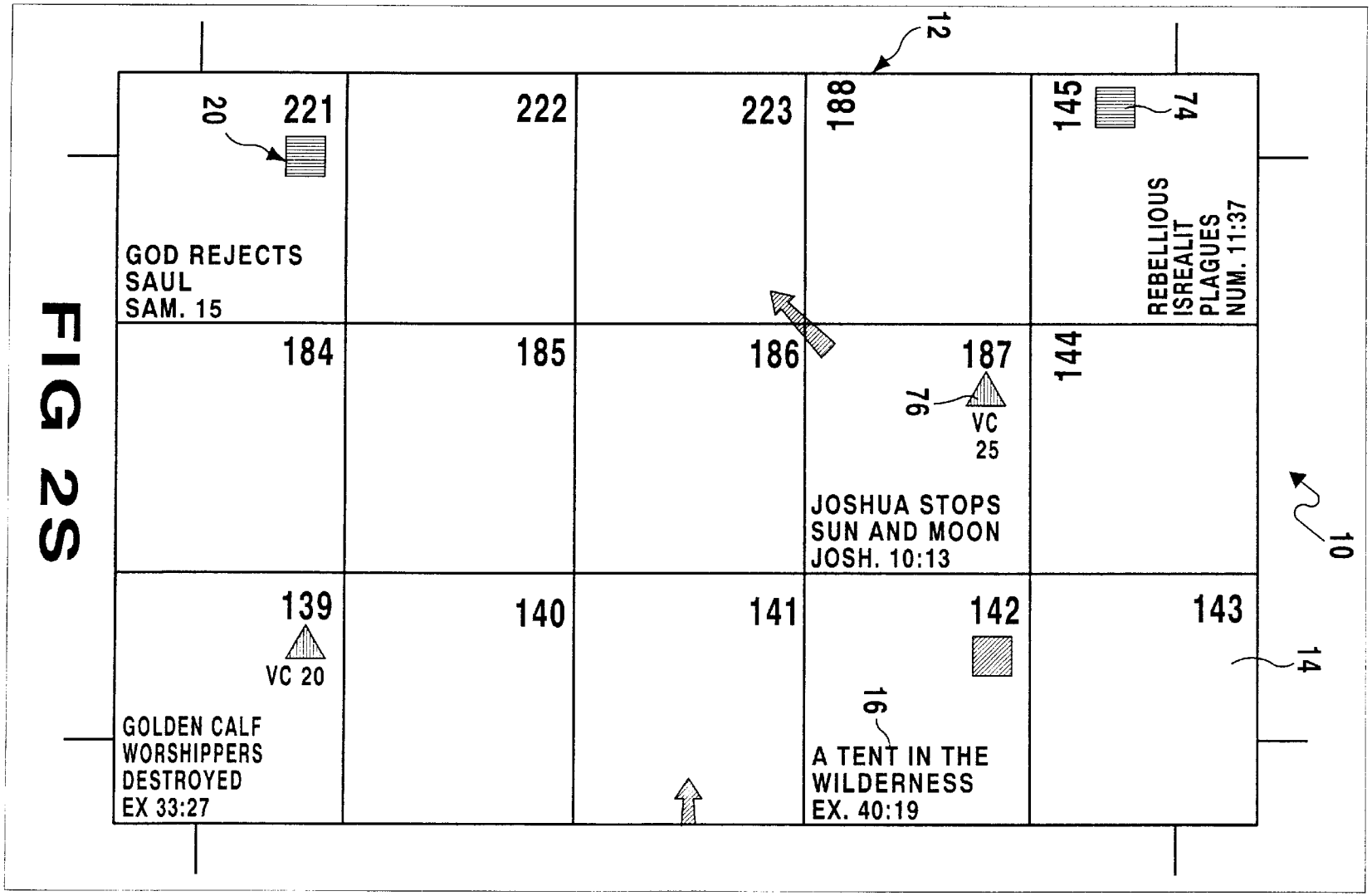
Figure 2T:
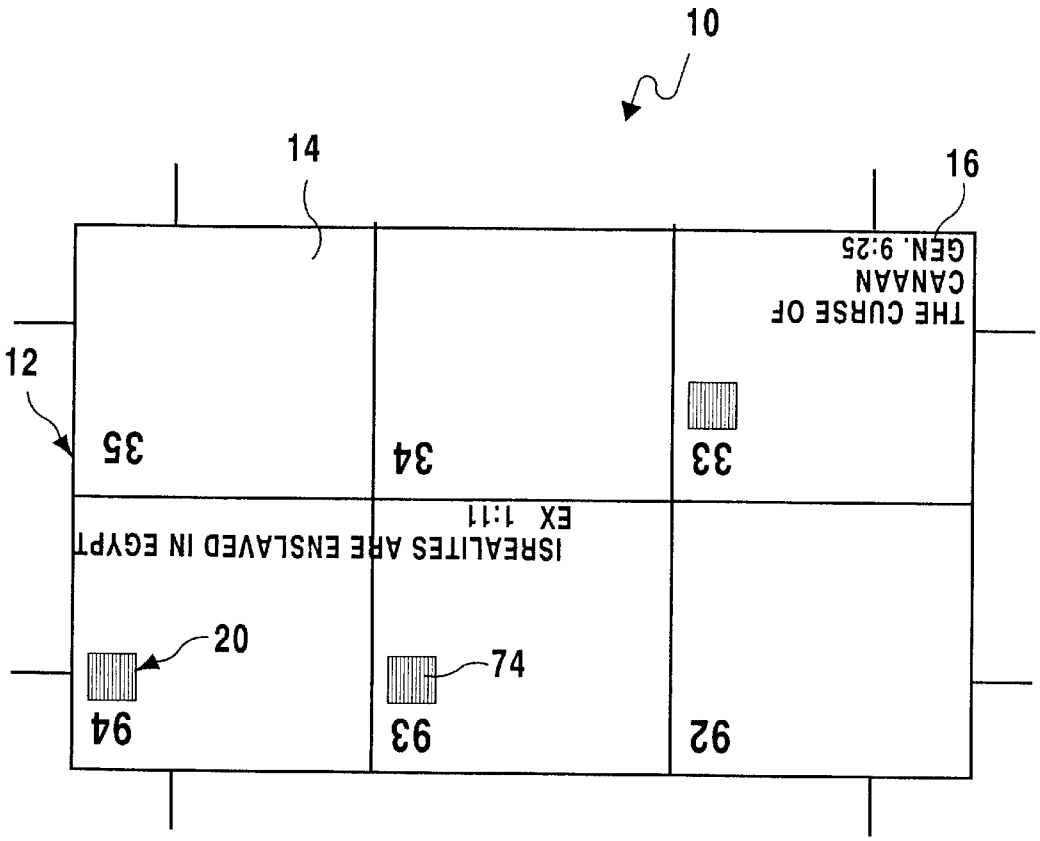
Figure 2U:
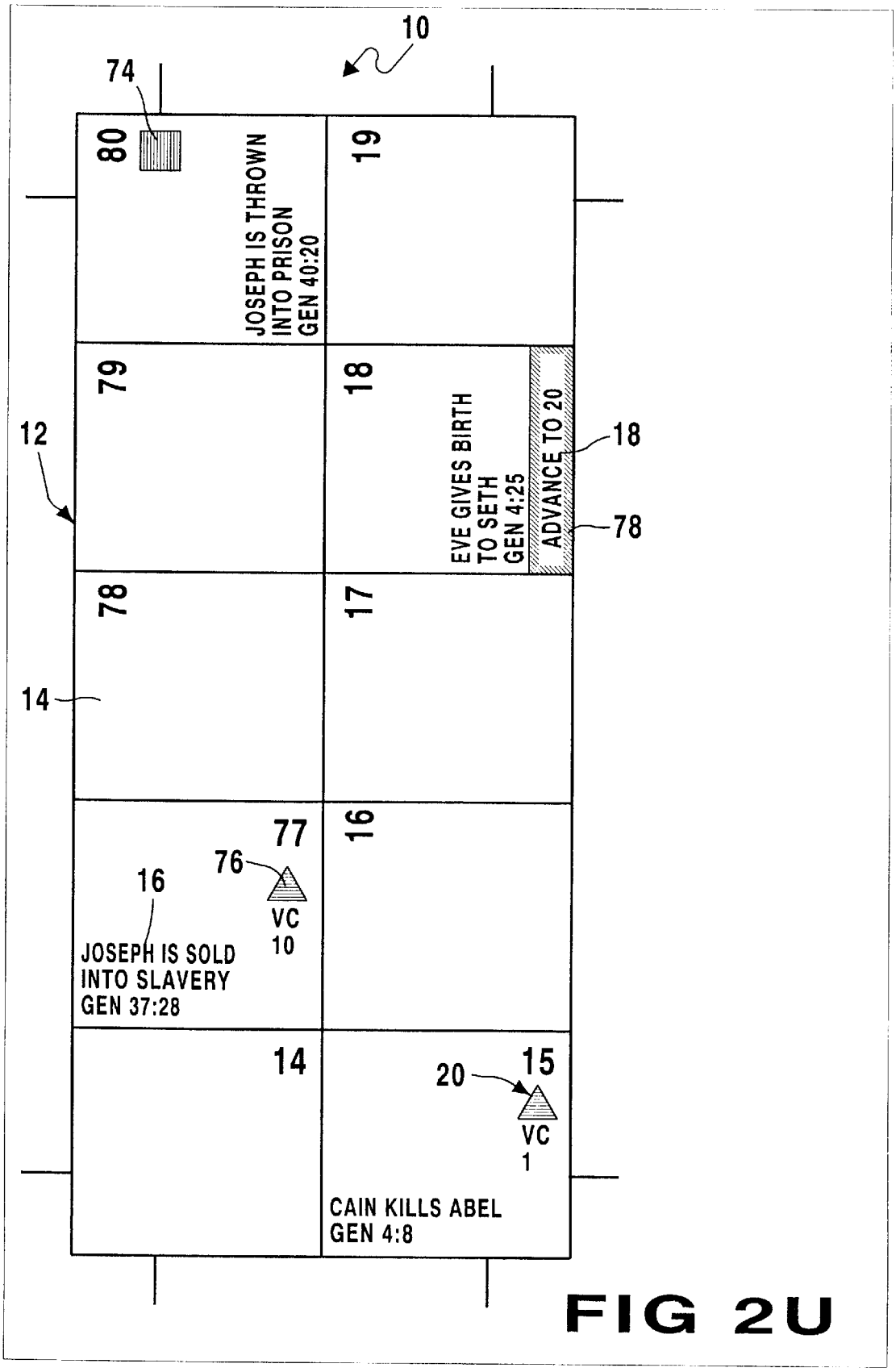
Figure 2V:
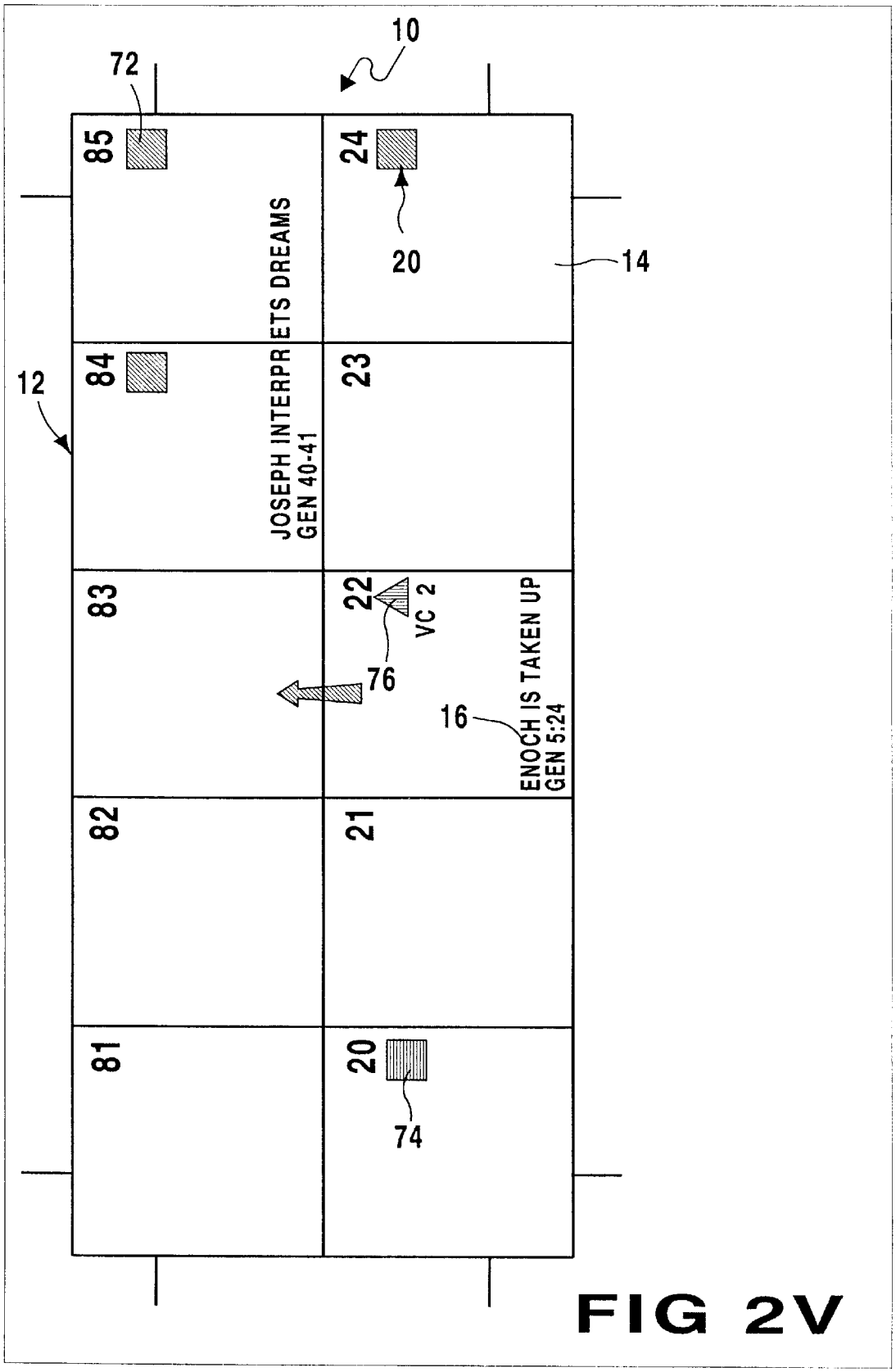
Figure 2W:
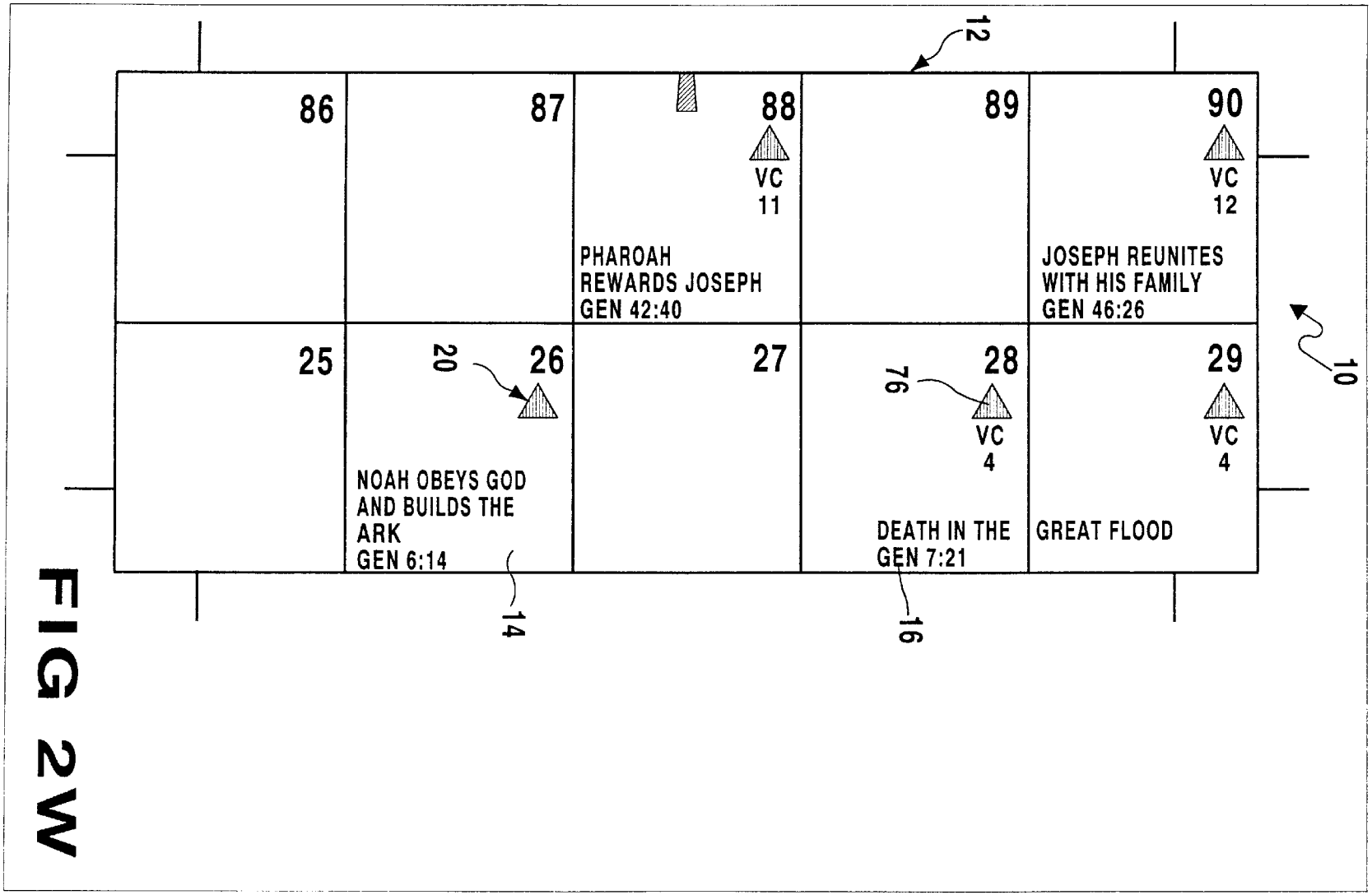
Figure 2X:
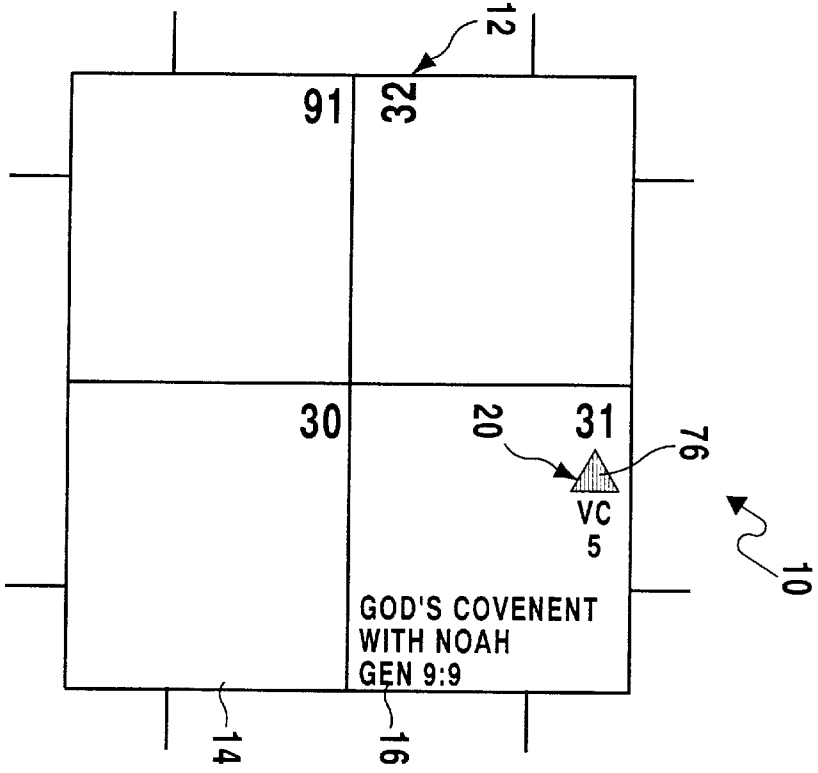
Figure 3:
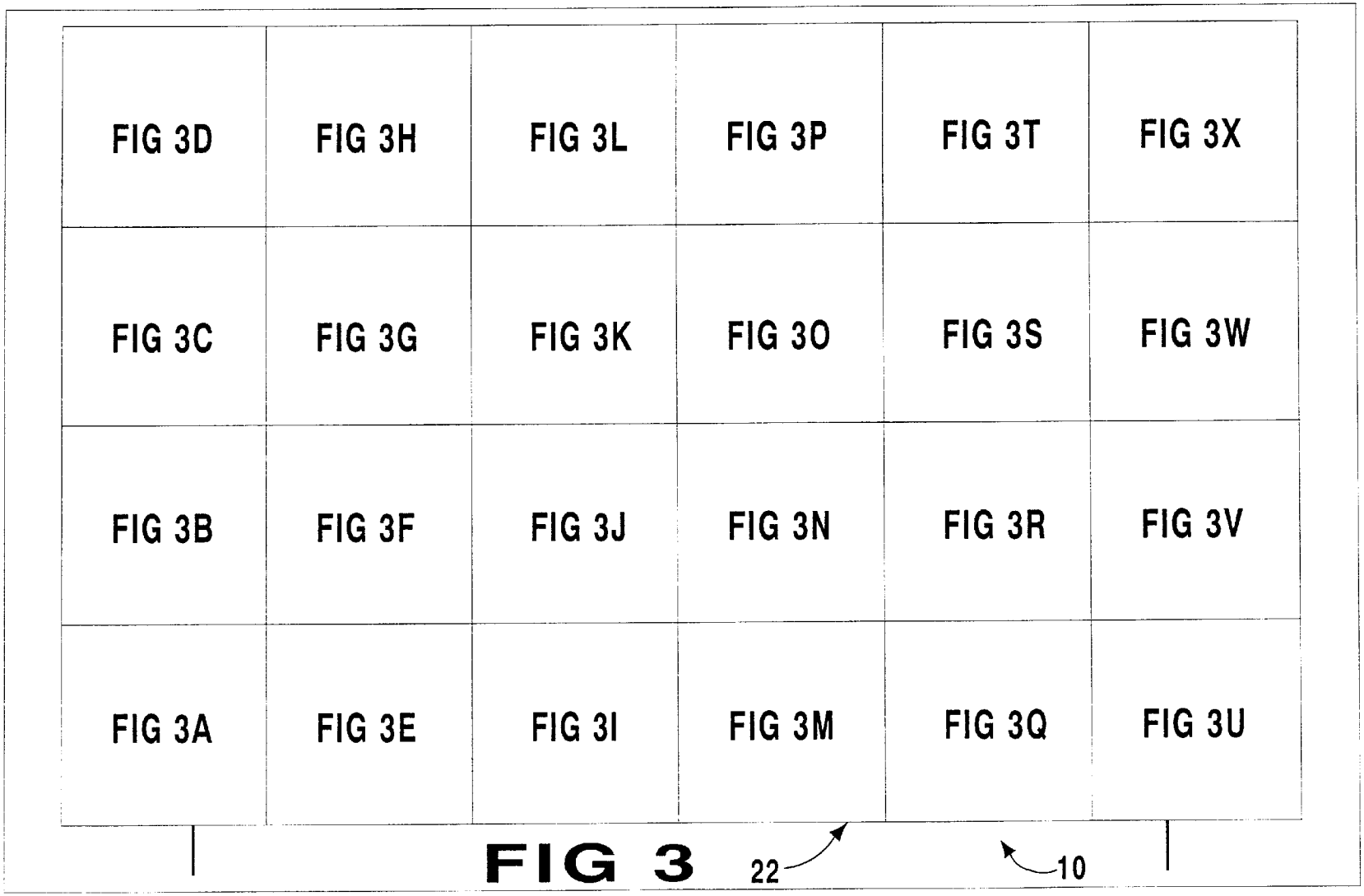
FIG. 3 is a diagrammatic plan view of a grid pattern for the various parts of the new testament game board in FIG. 1.
Figure 3A:
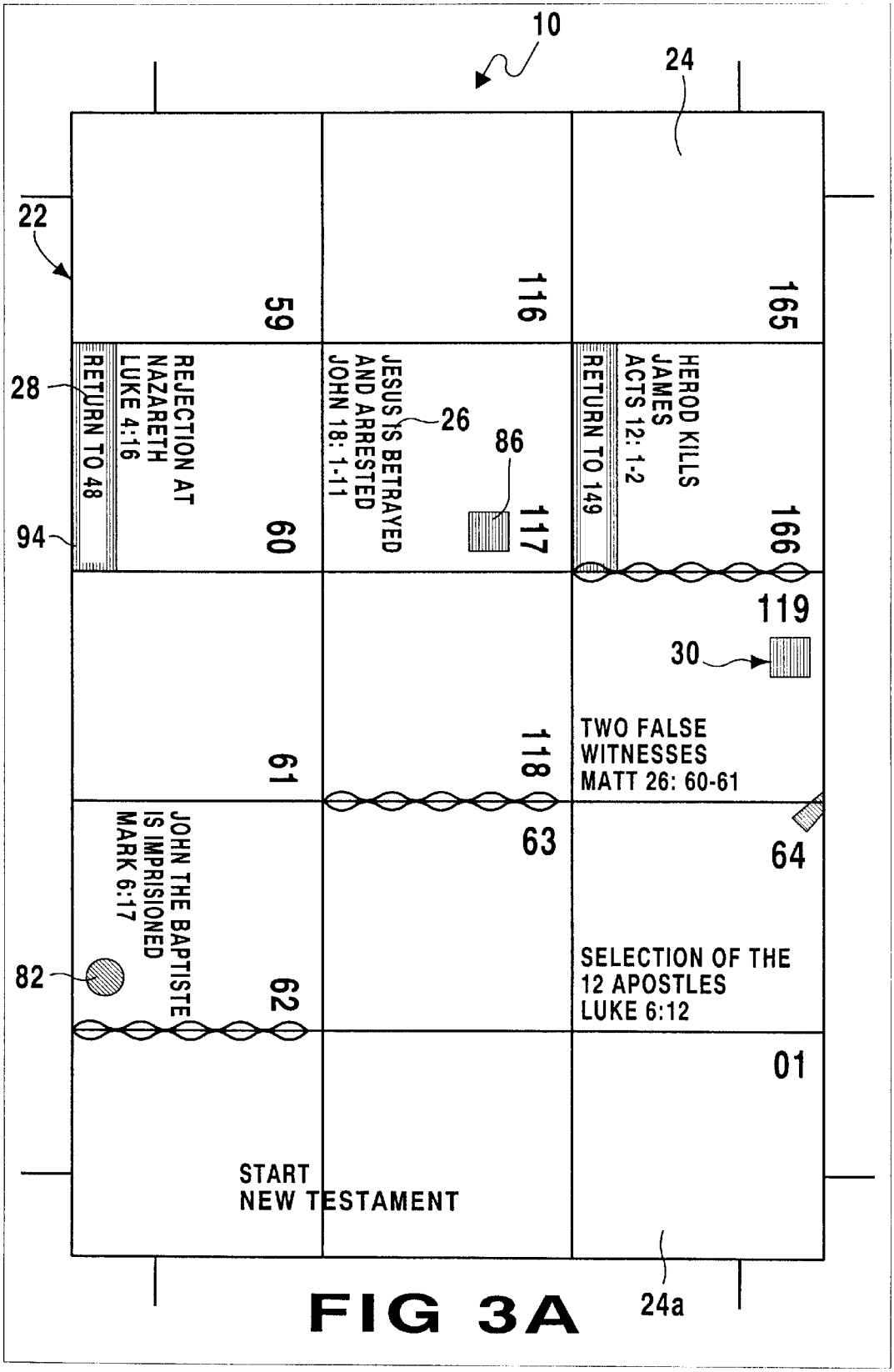
FIG. 3A through 3X are enlarged plan views of the various parts of the new testament game board indicated in FIG. 3.
Figure 3B:
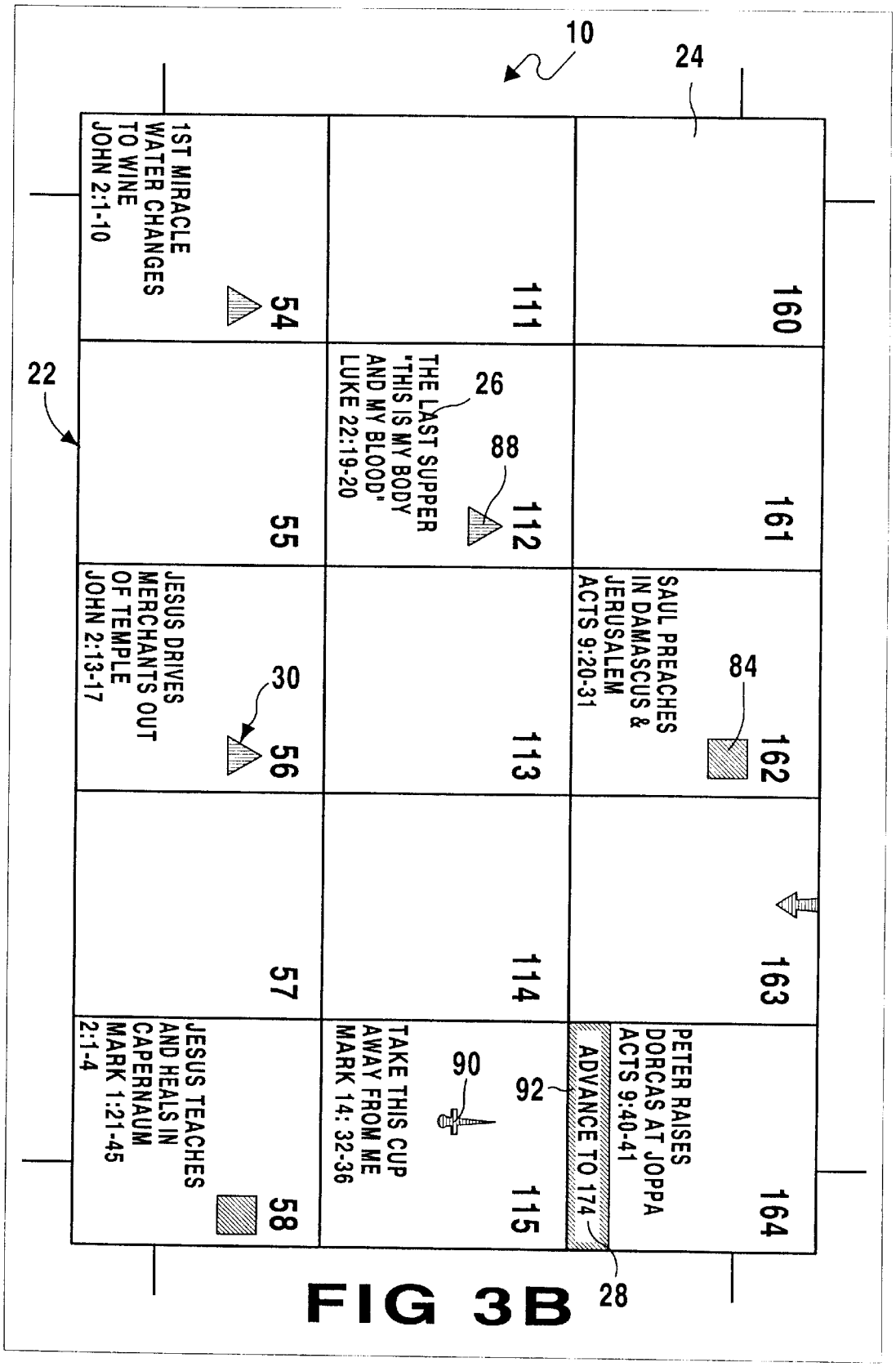
Figure 3C:
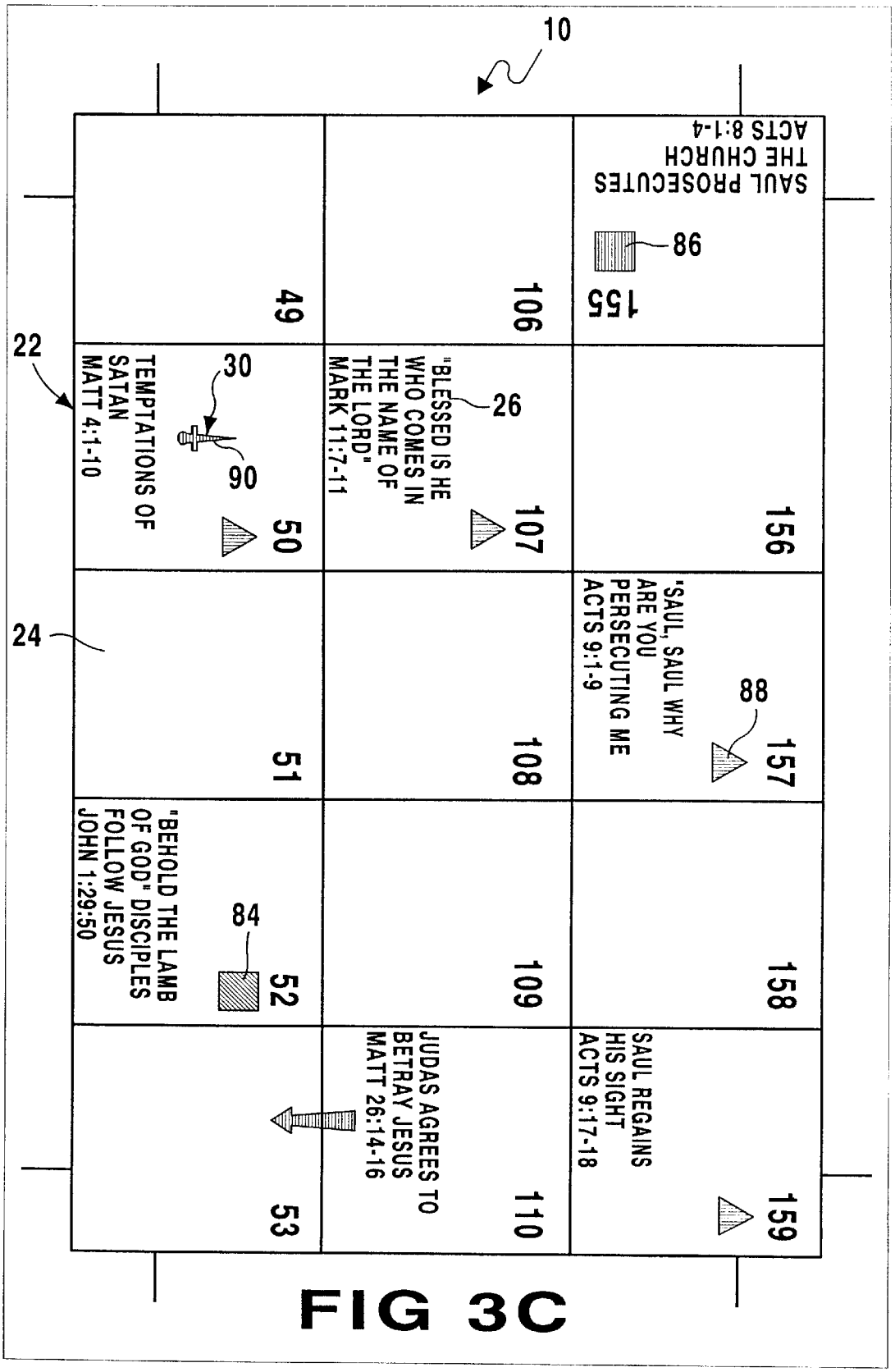
Figure 3D:
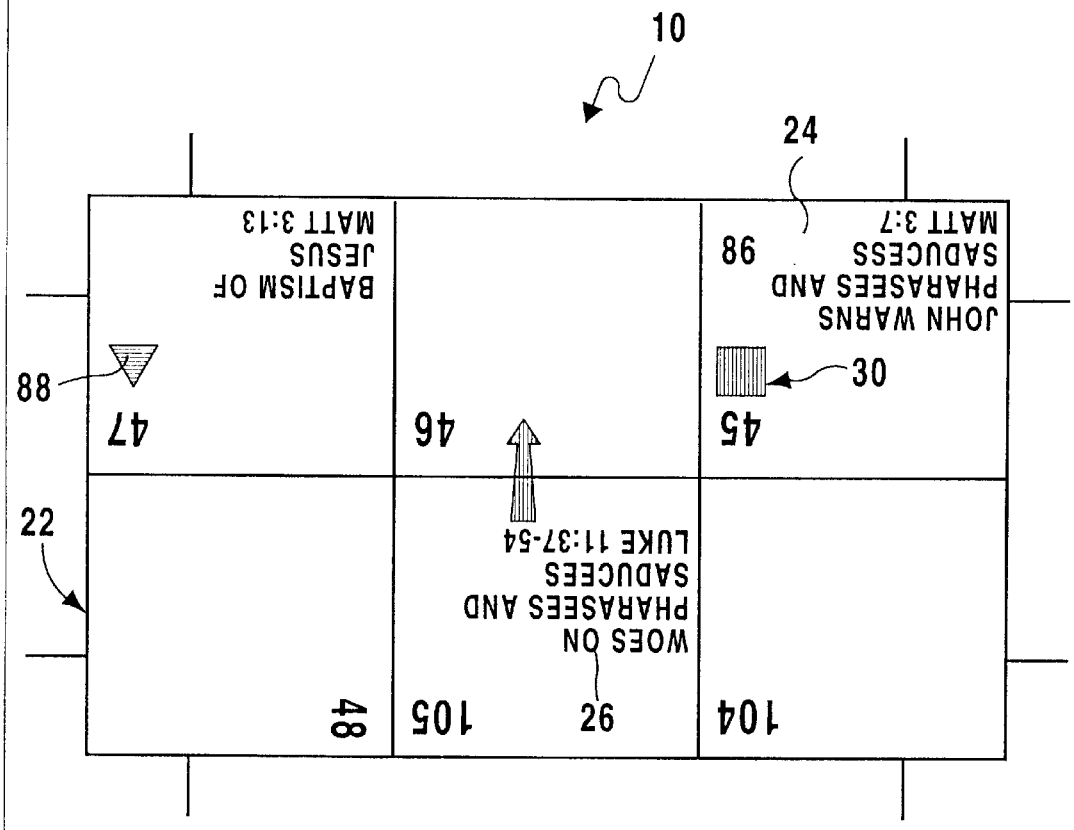
Figure 3E:
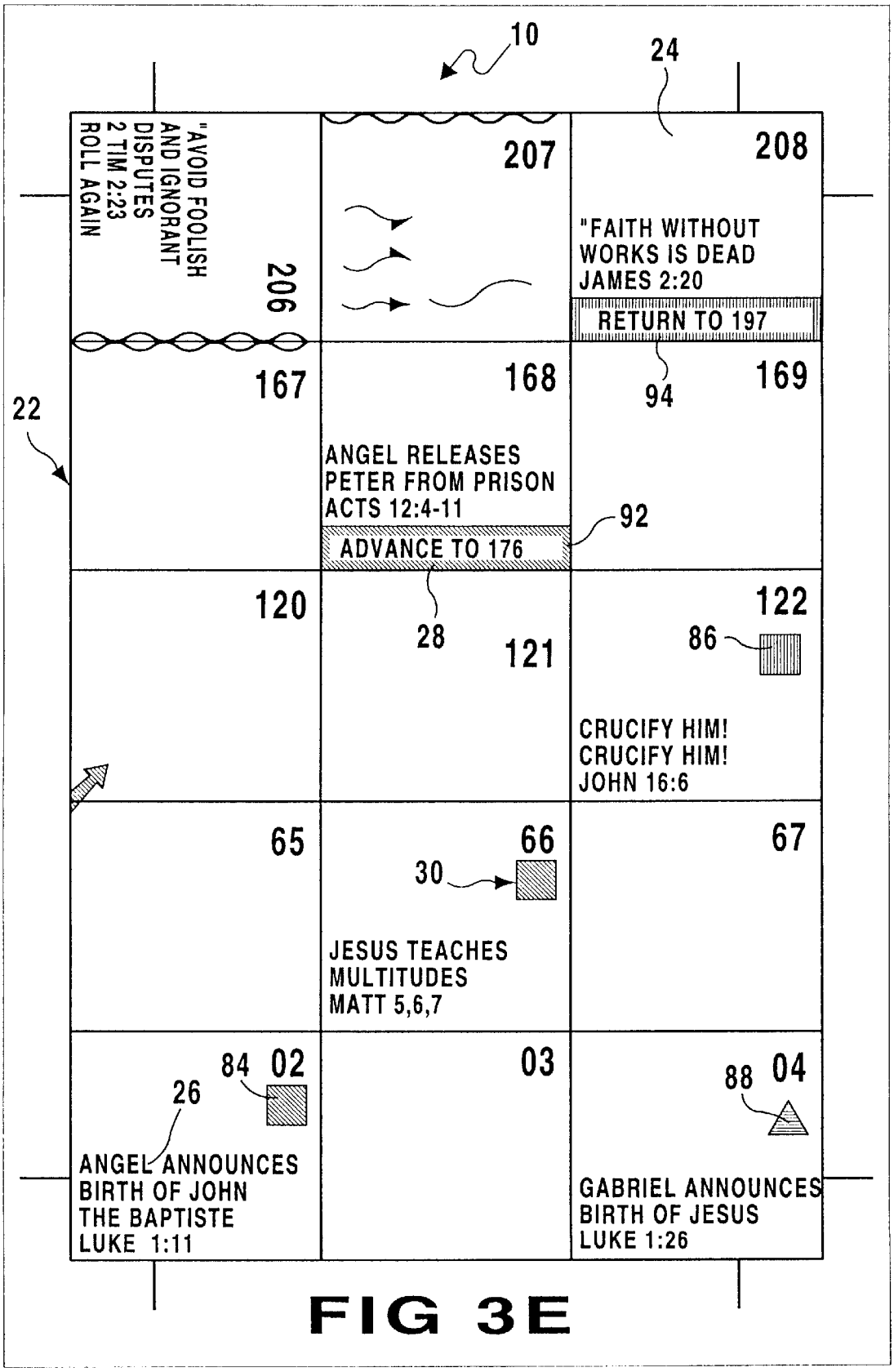
Figure 3F:
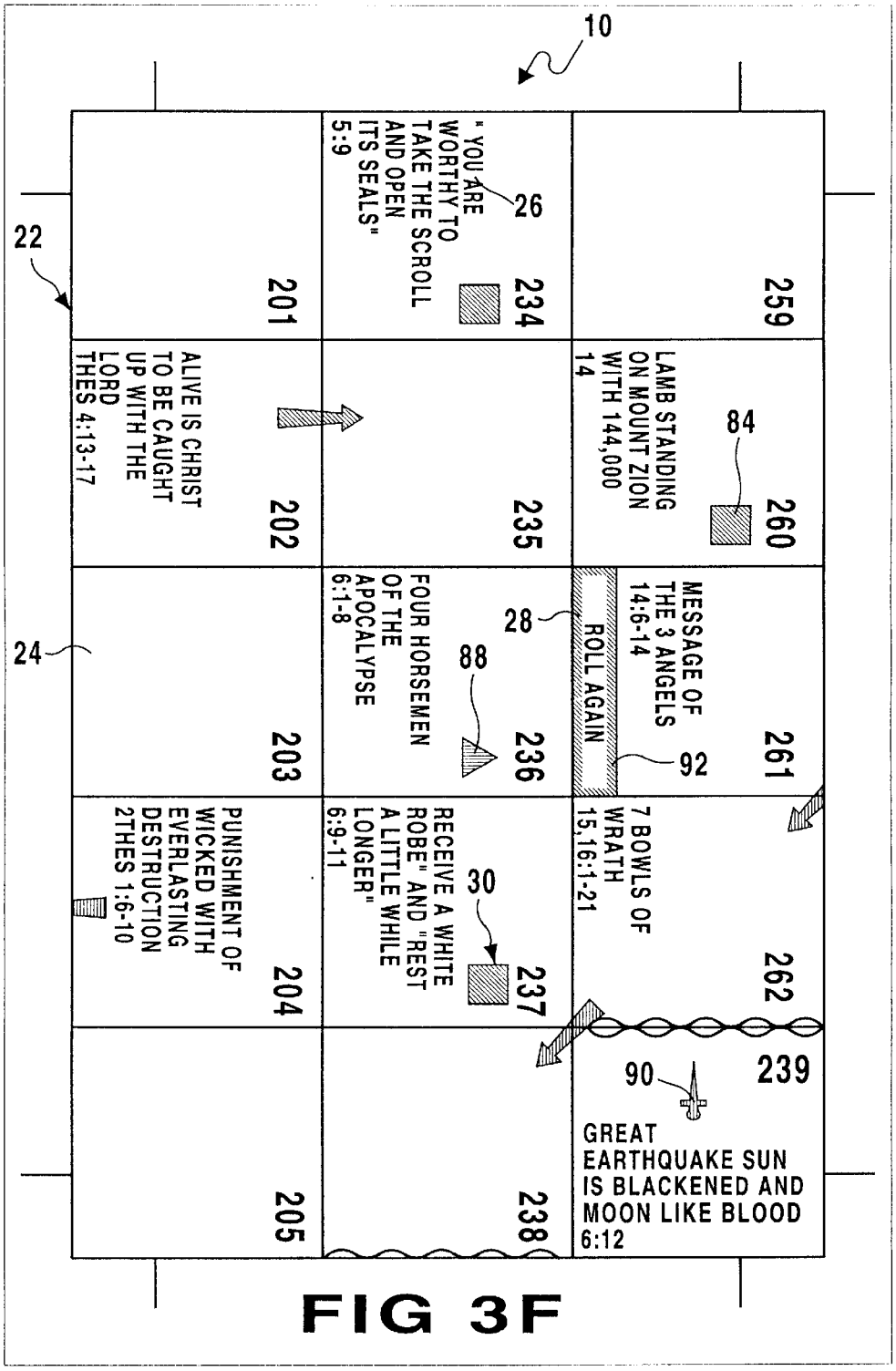
Figure 3G:
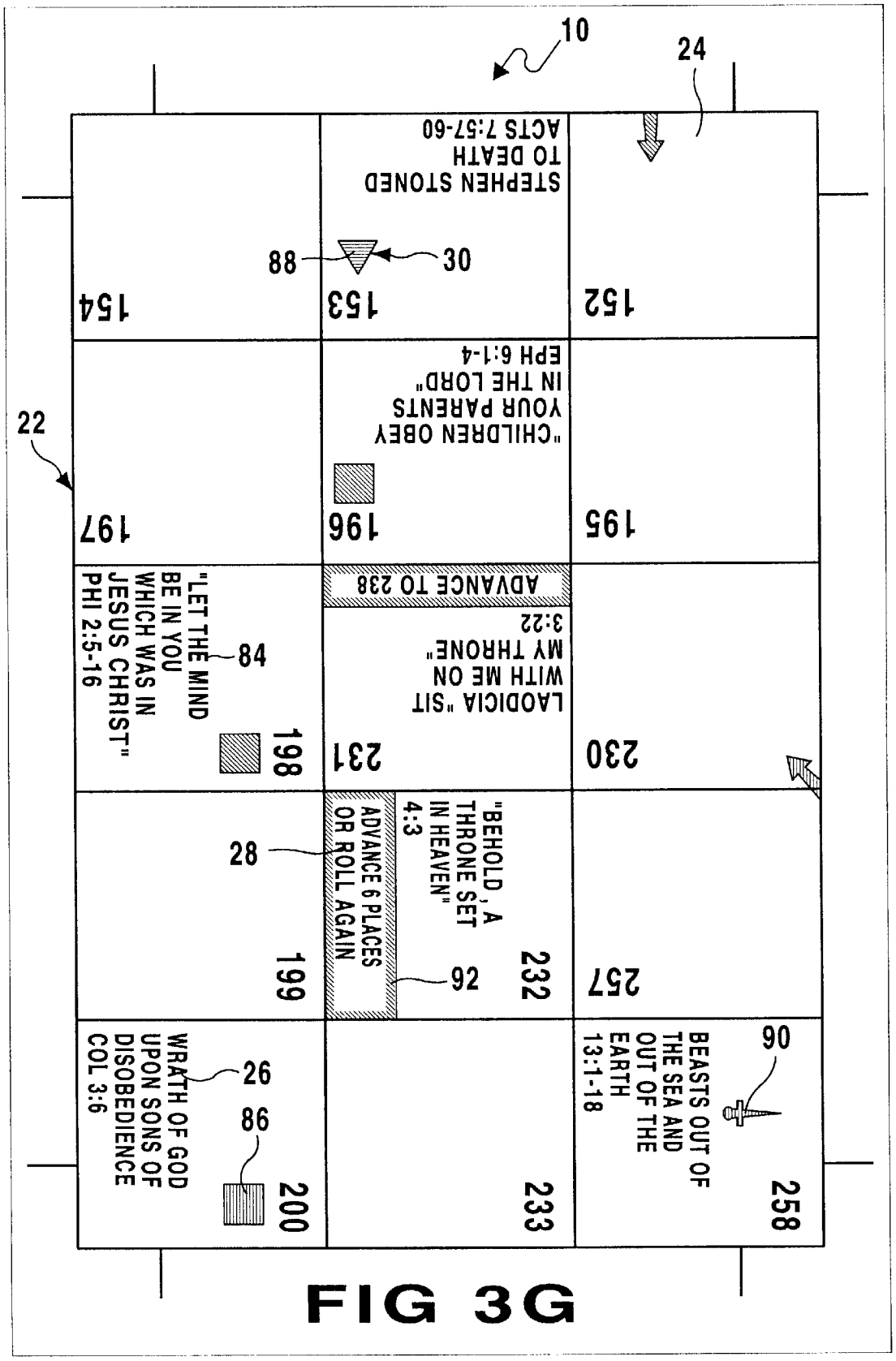
Figure 3H:
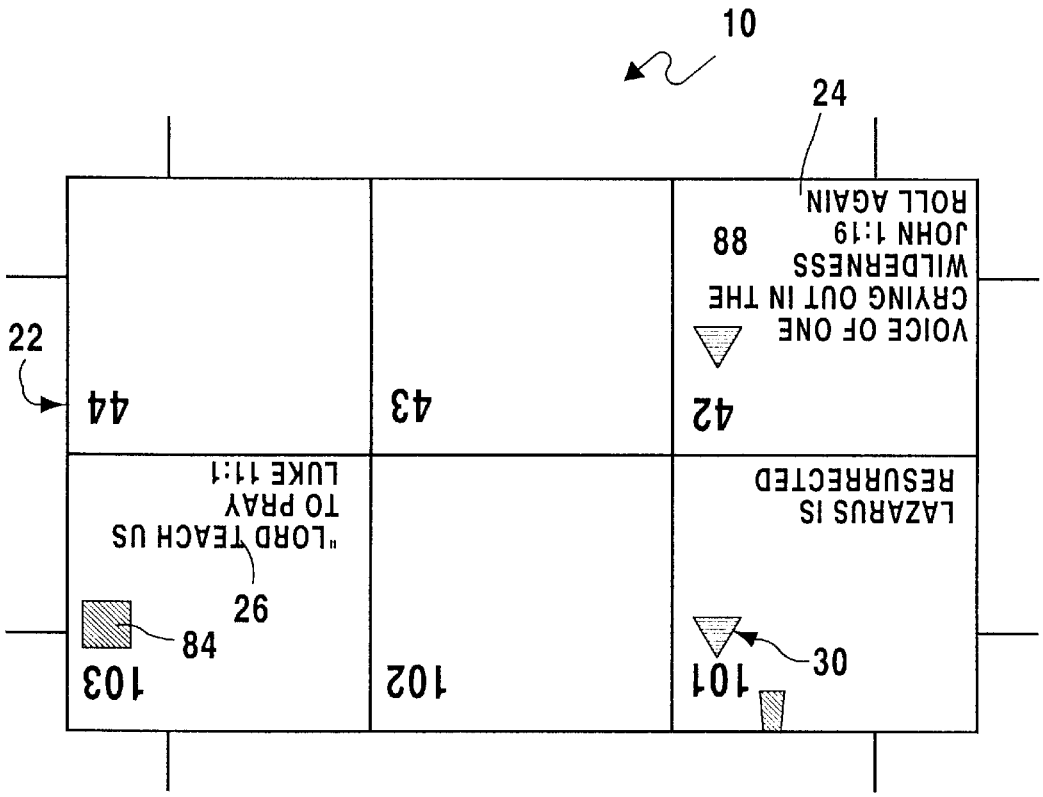
Figure 31:
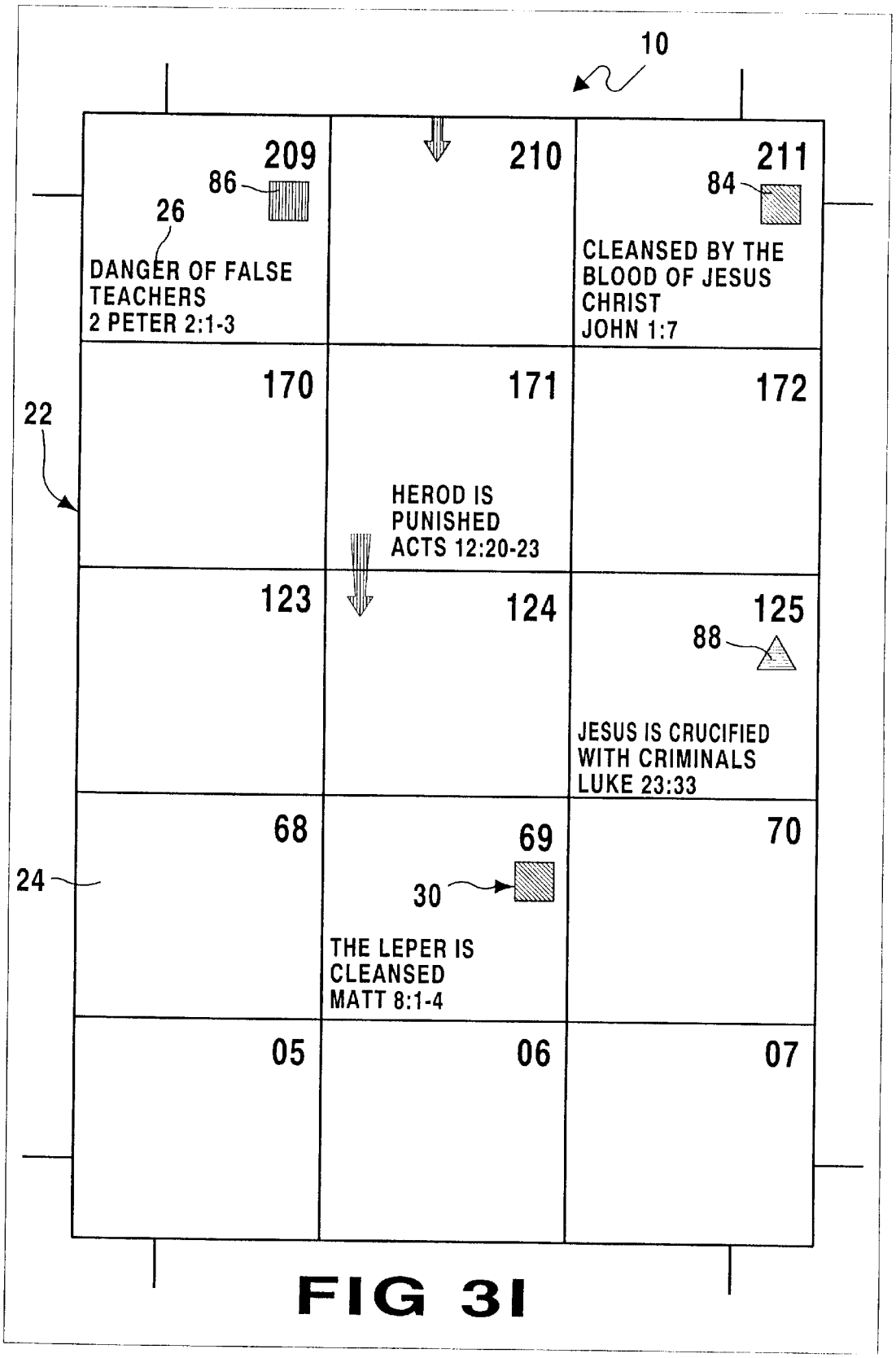
Figure 3J:
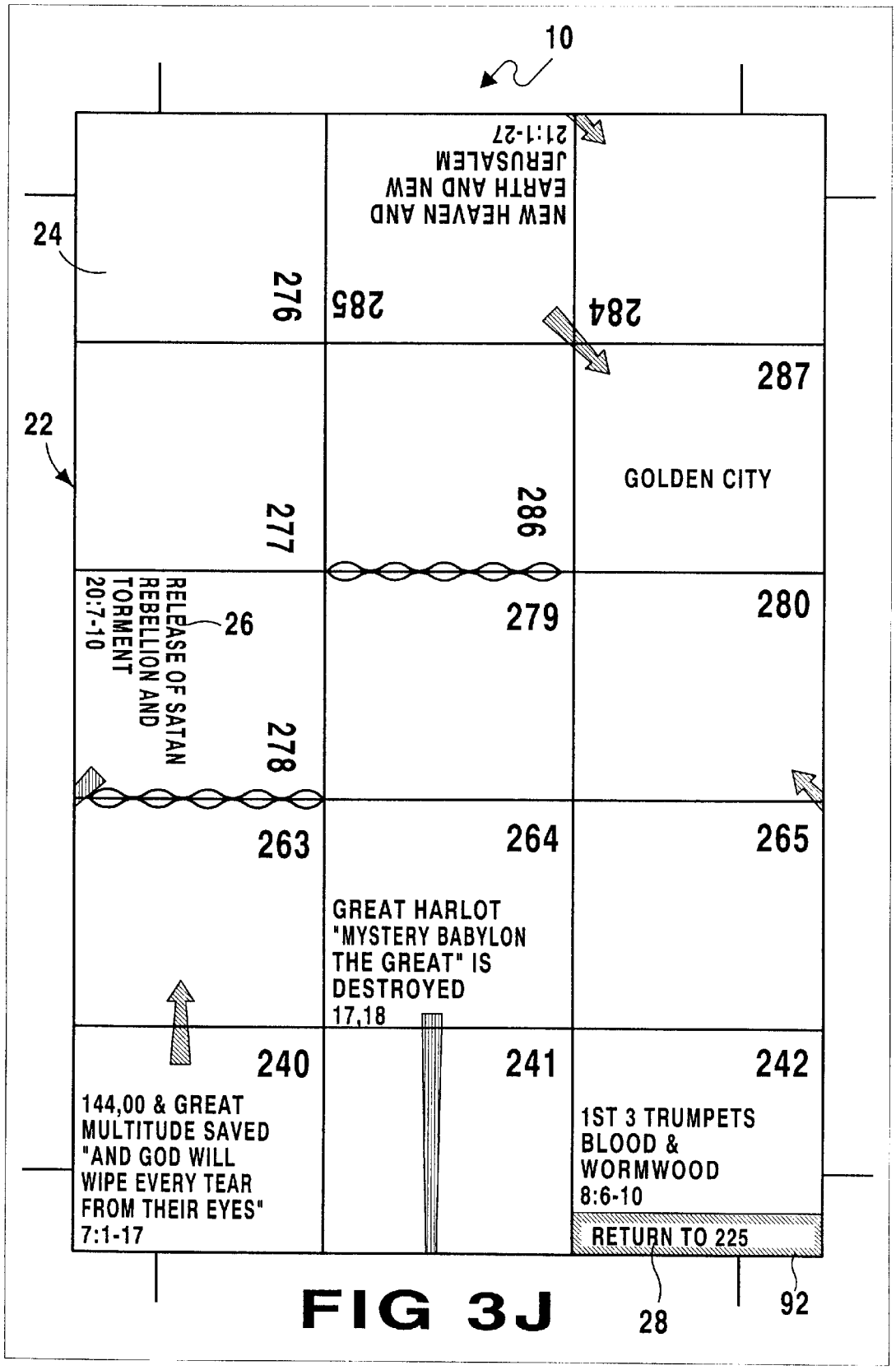
Figure 3K:
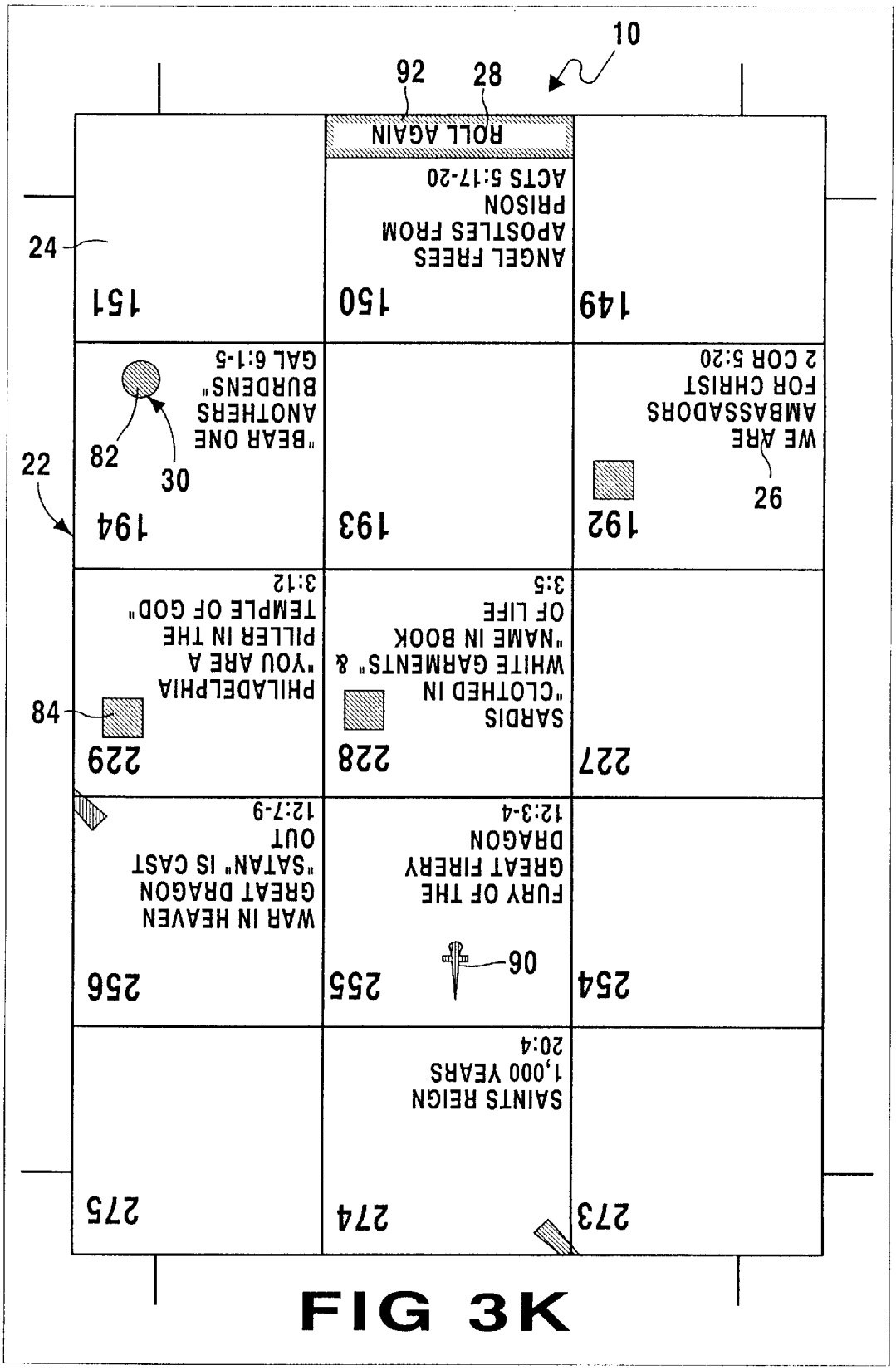
Figure 3L:
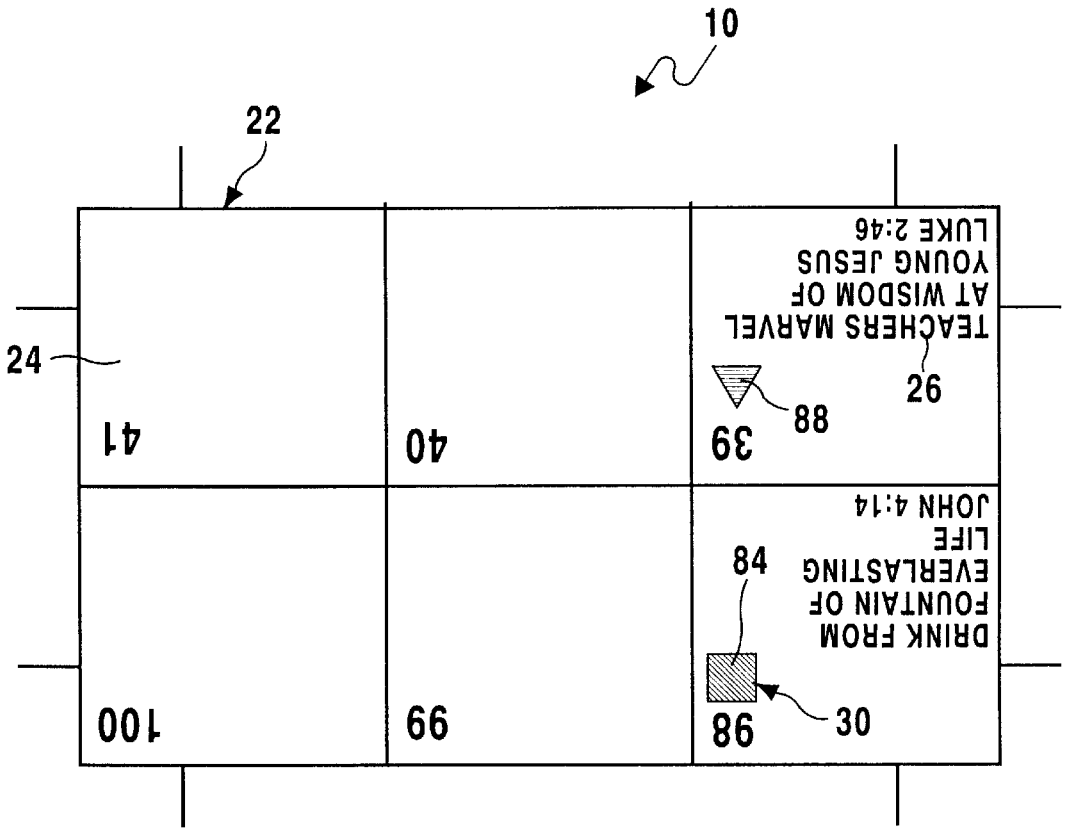
Figure 3M:
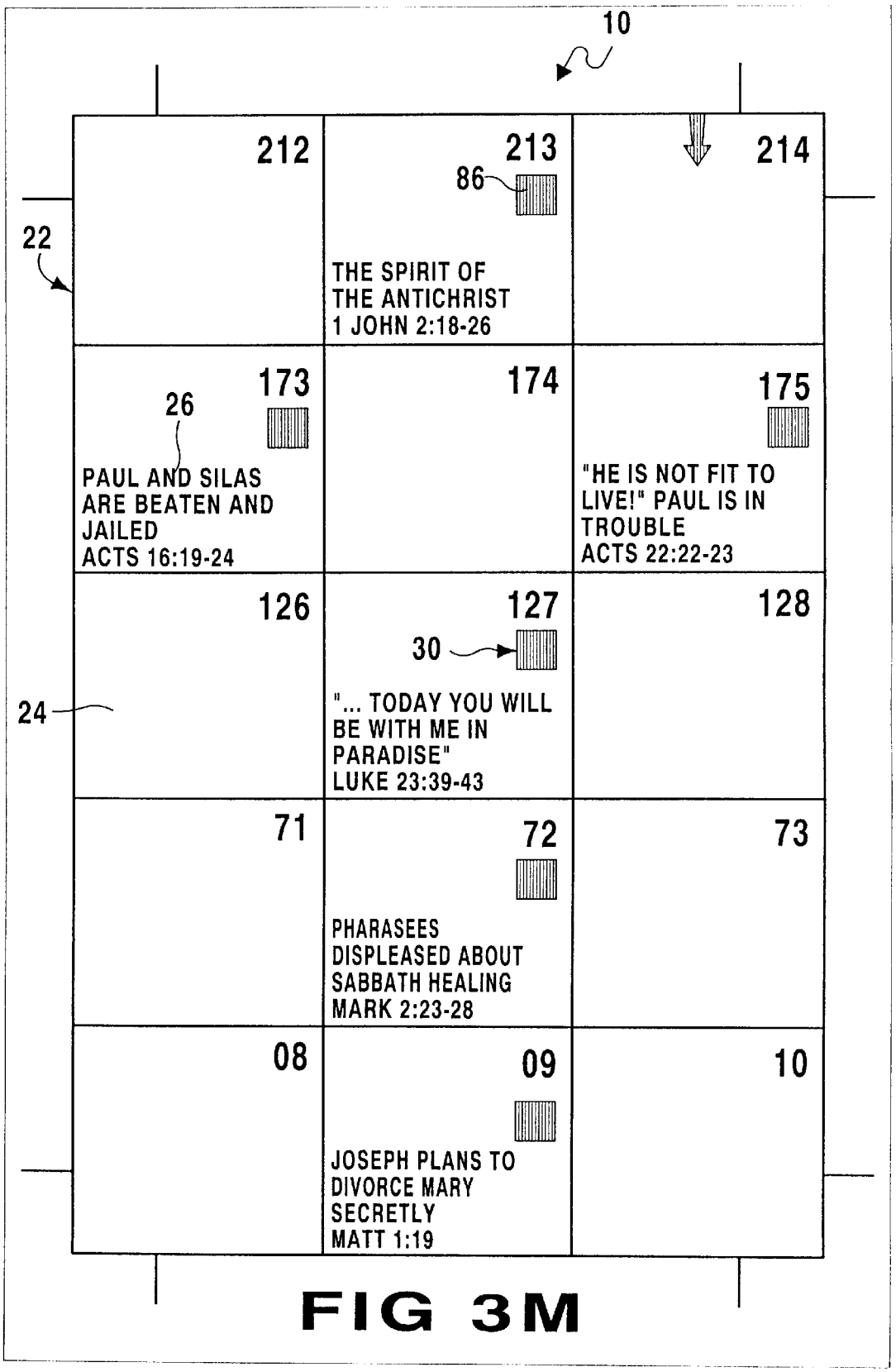
Figure 3N:
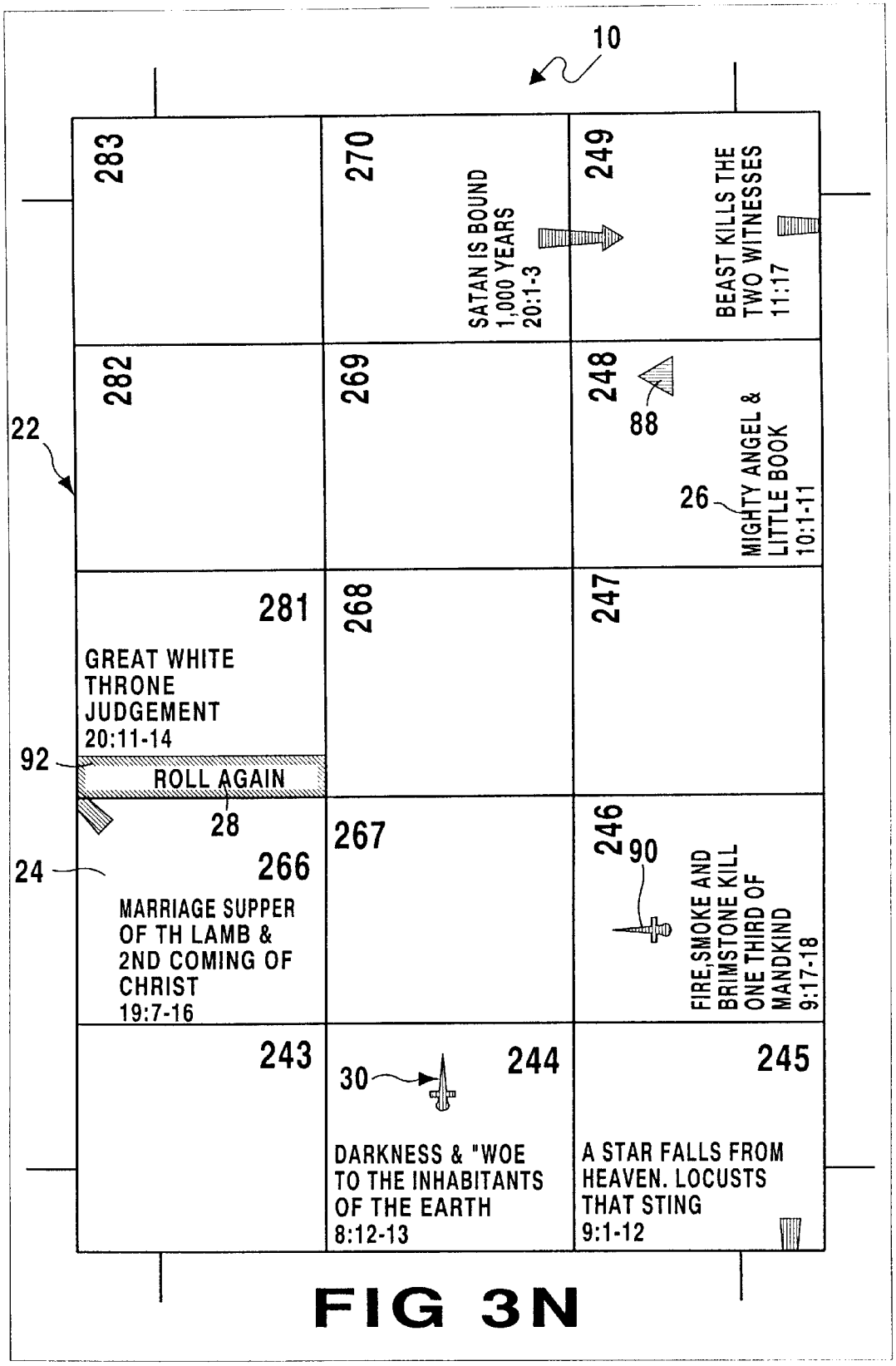
Figure 30:
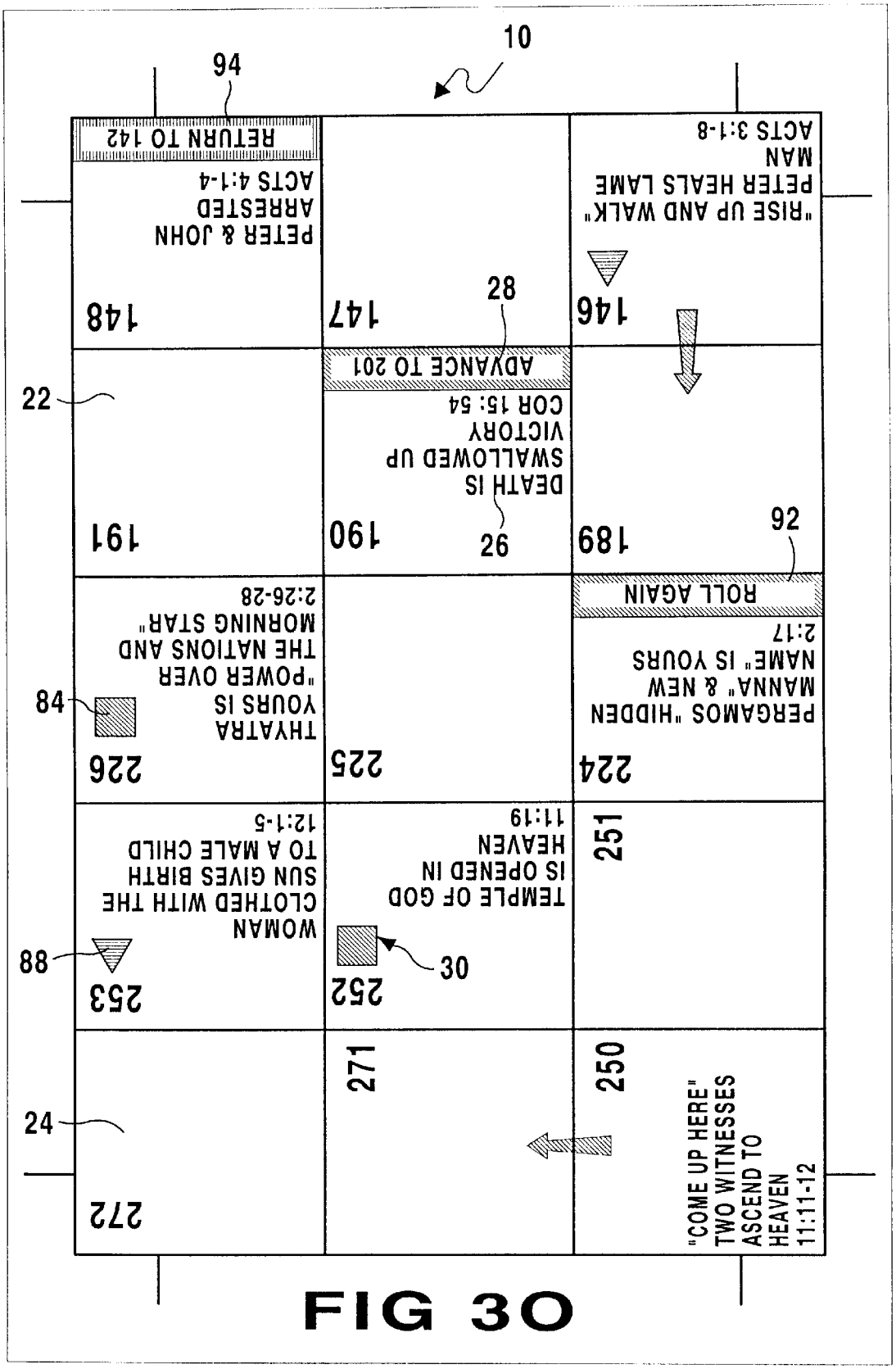
Figure 3P:
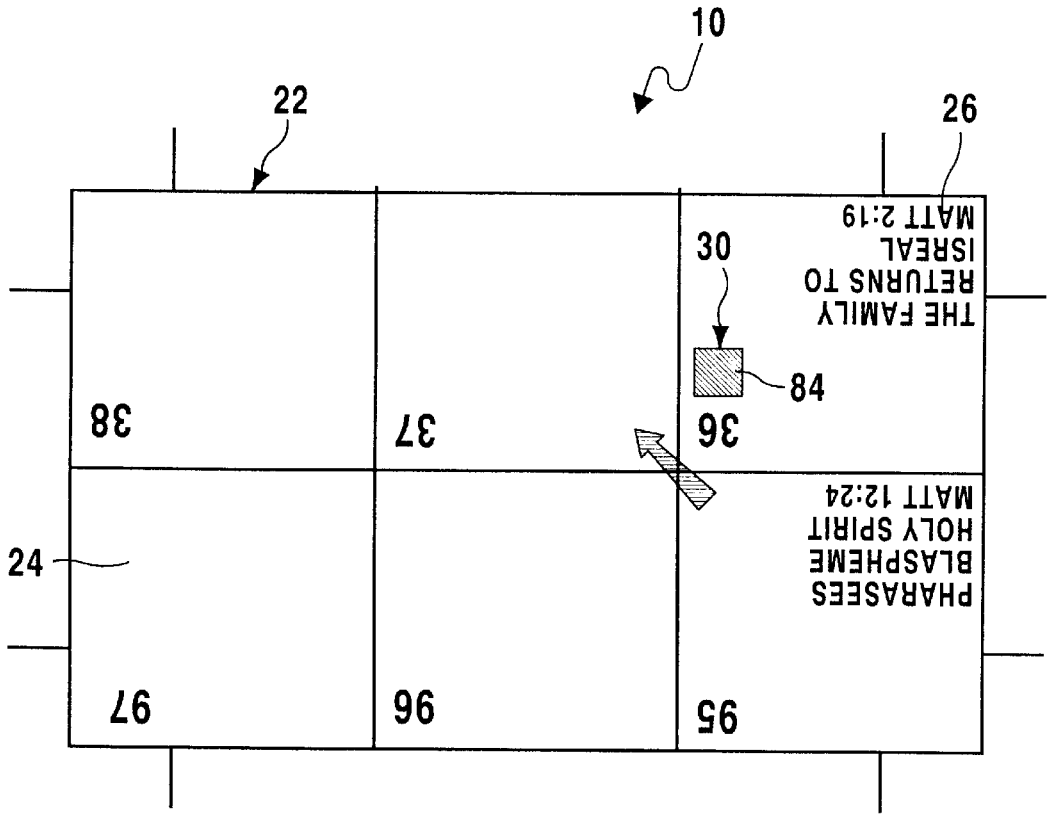
Figure 3Q:
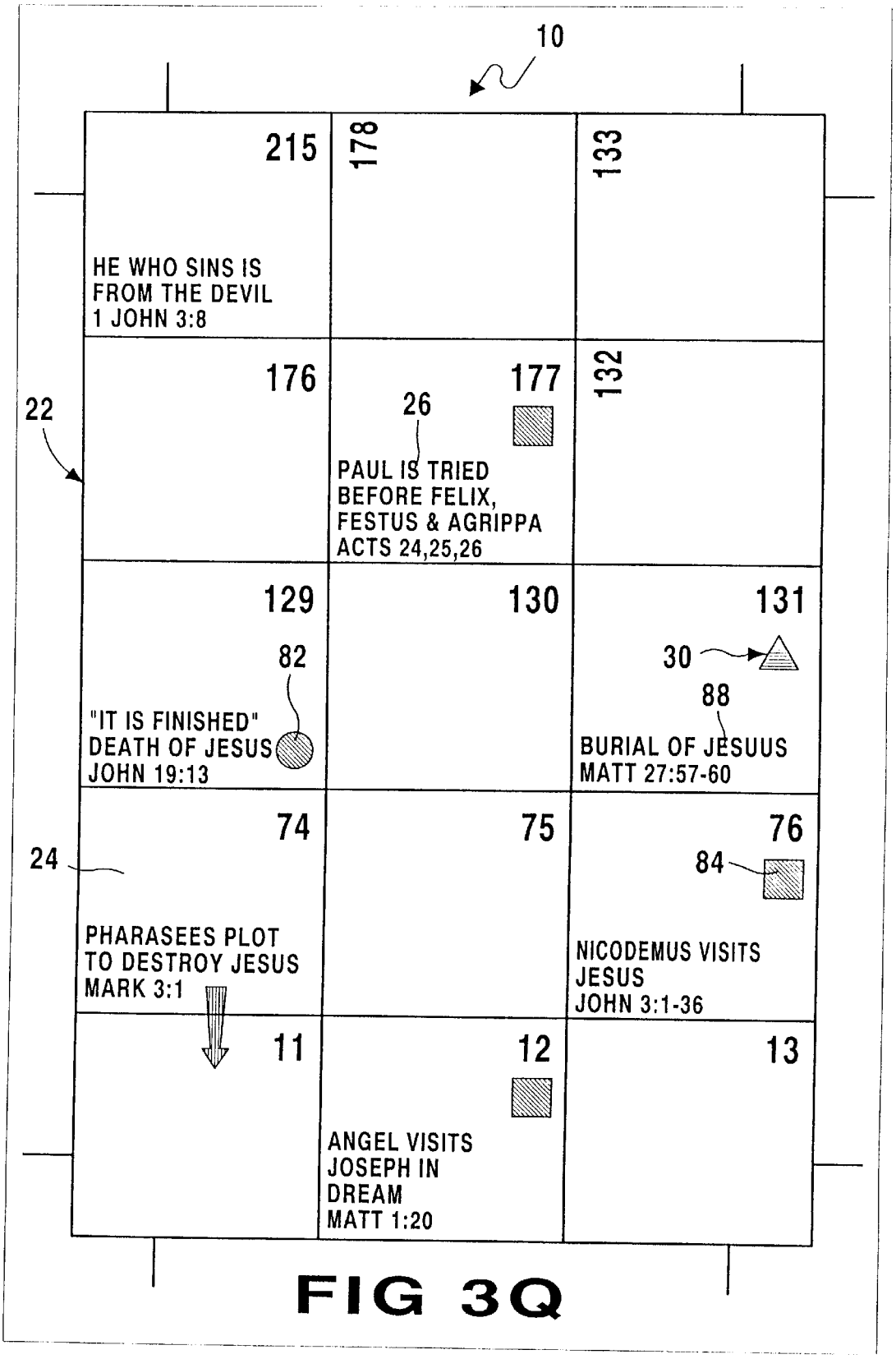
Figure 3R:
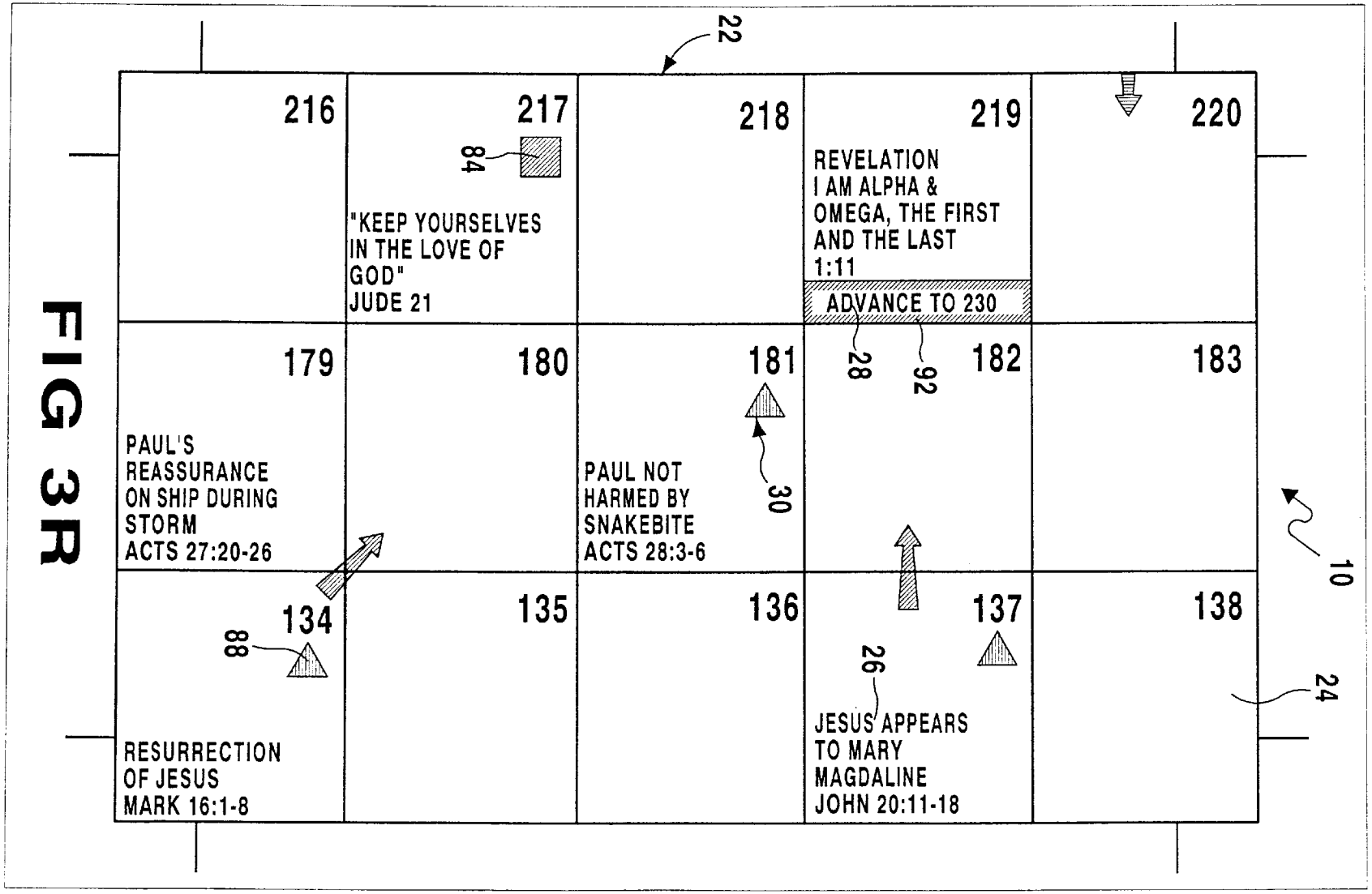
Figure 3S:
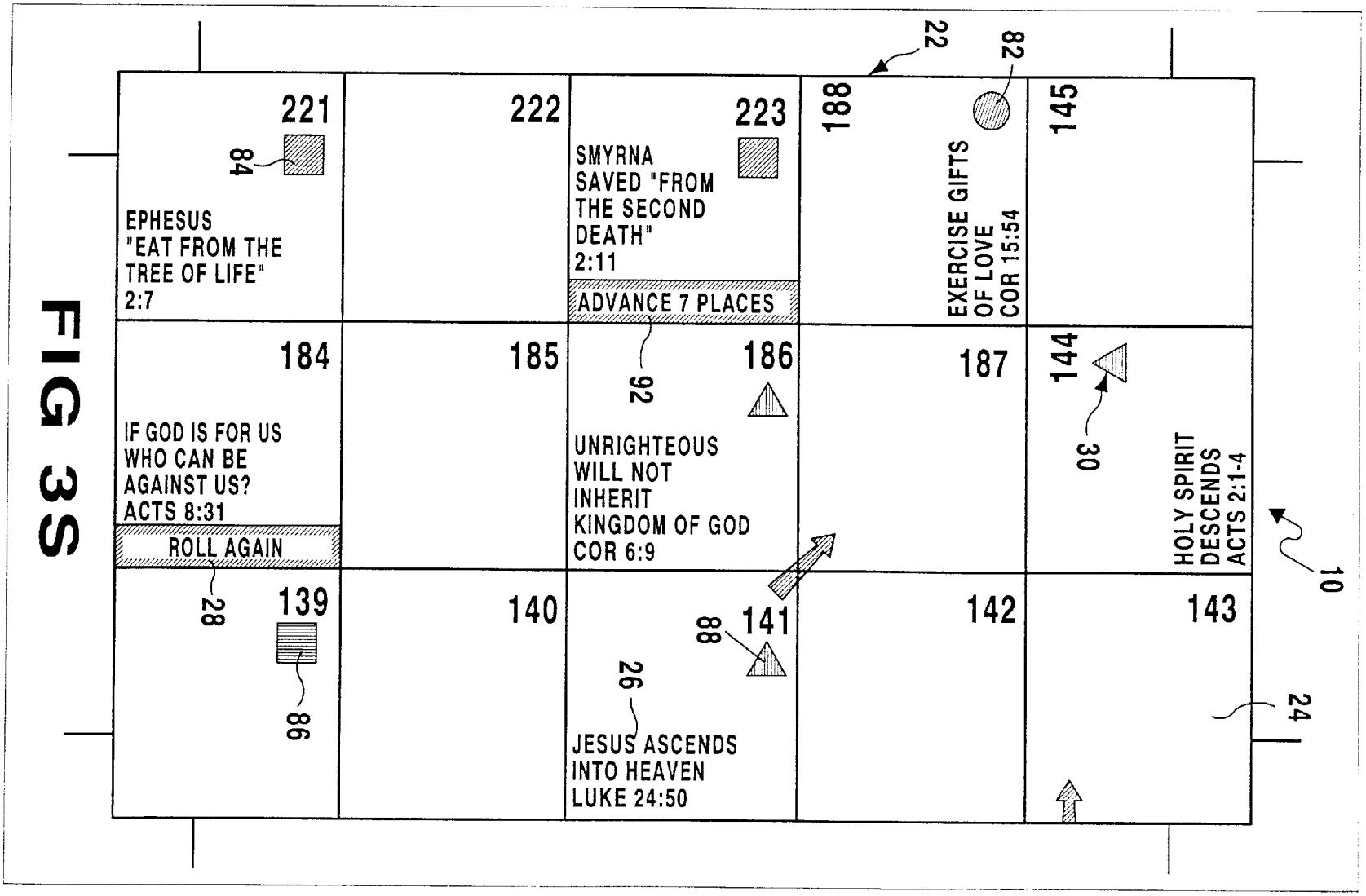
Figure 3T:
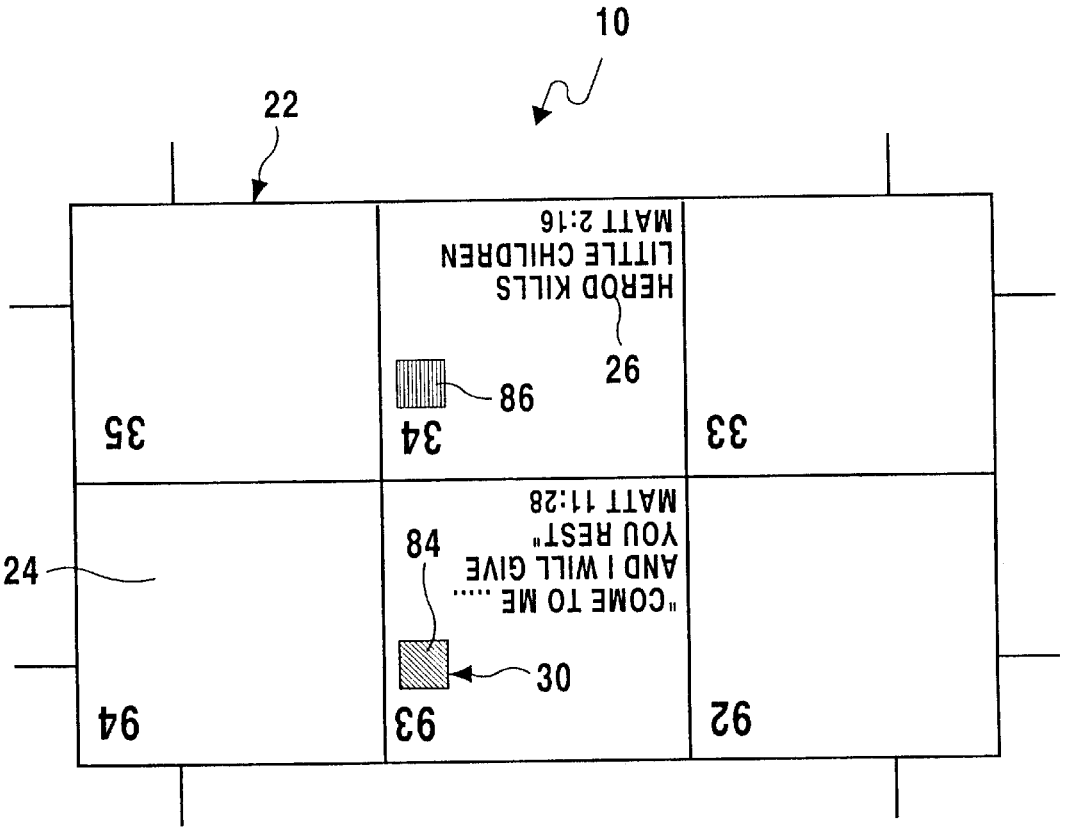
Figure 3U:
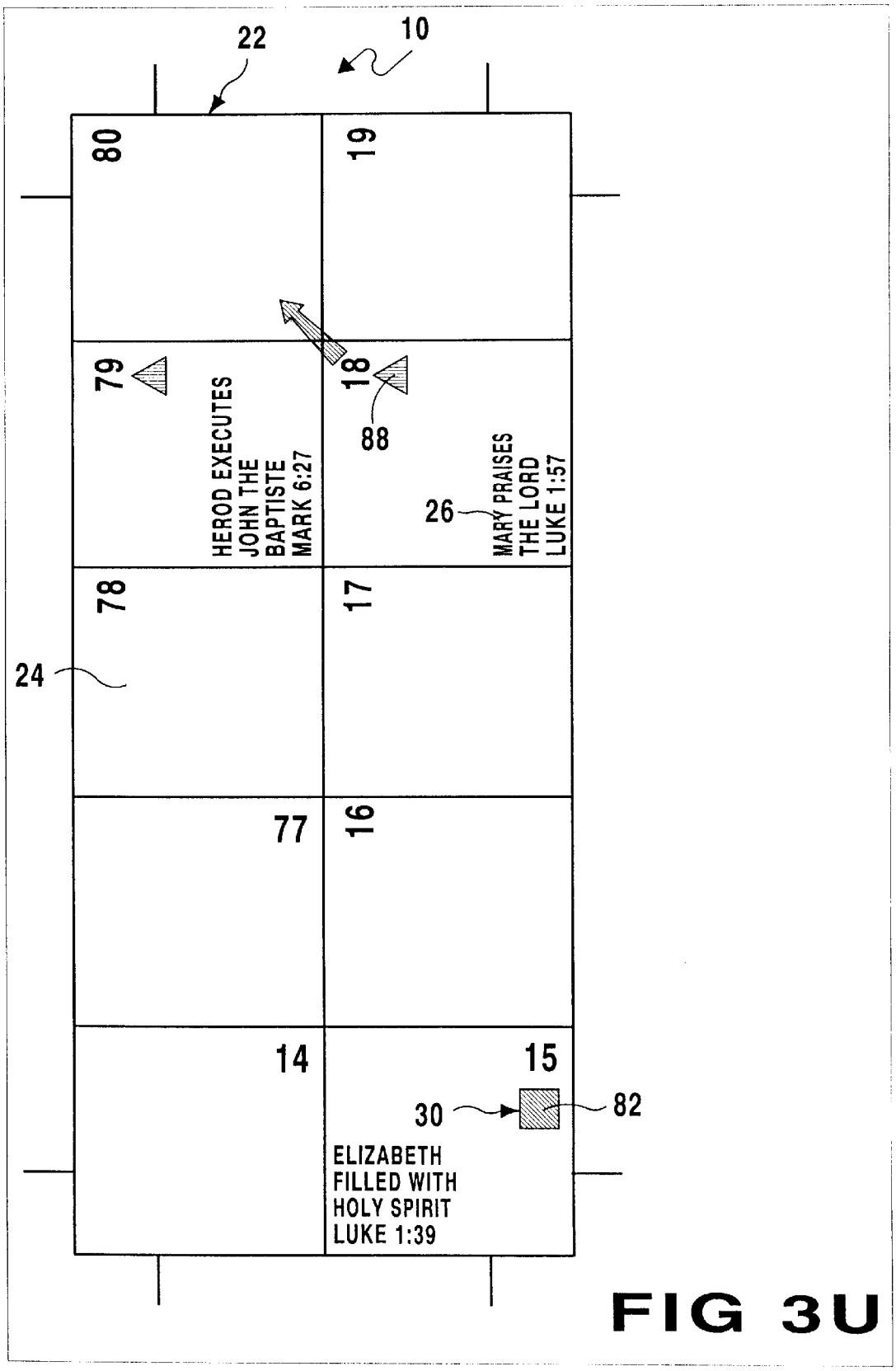
Figure 3V:
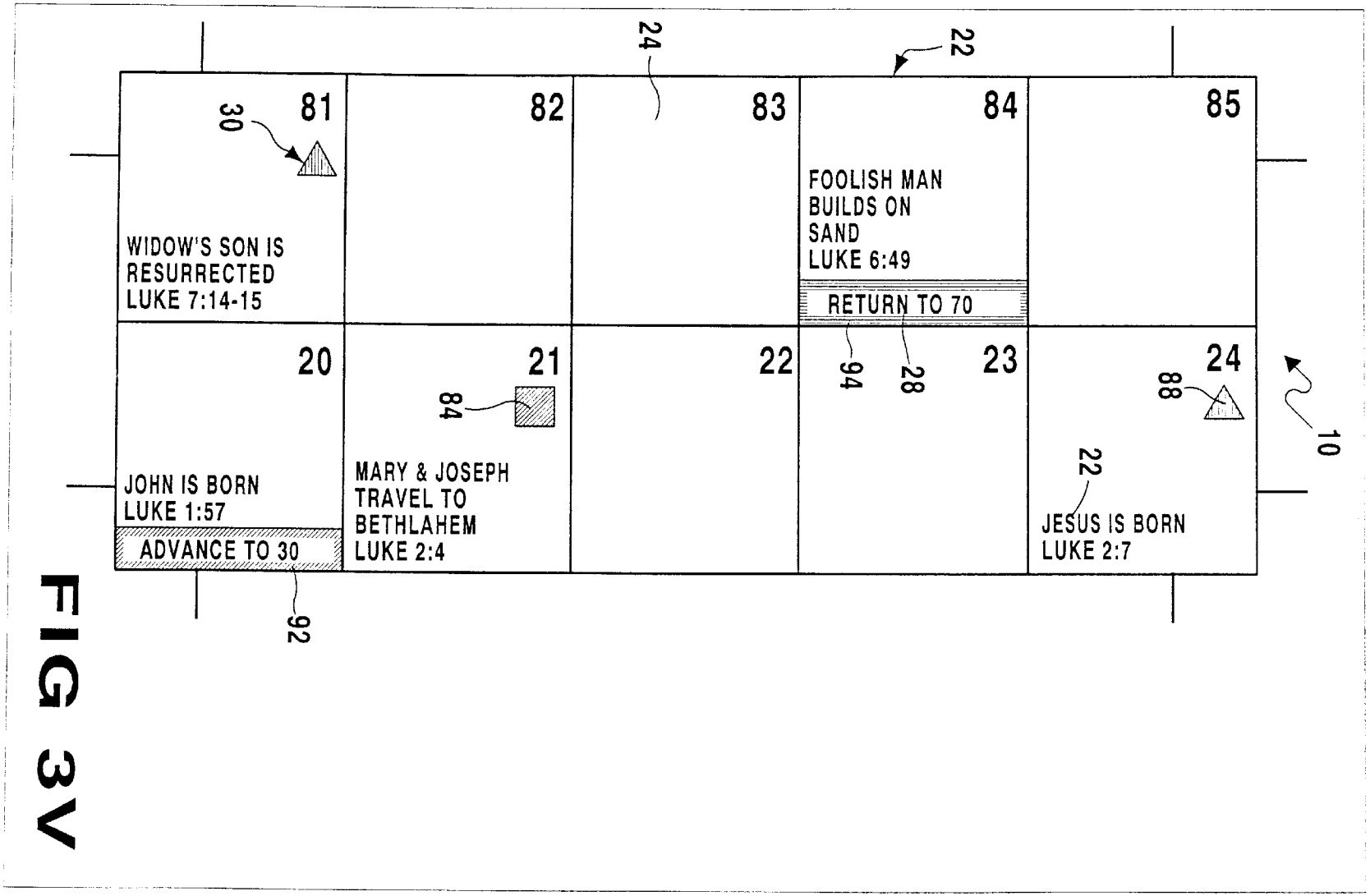
Figure 3W:
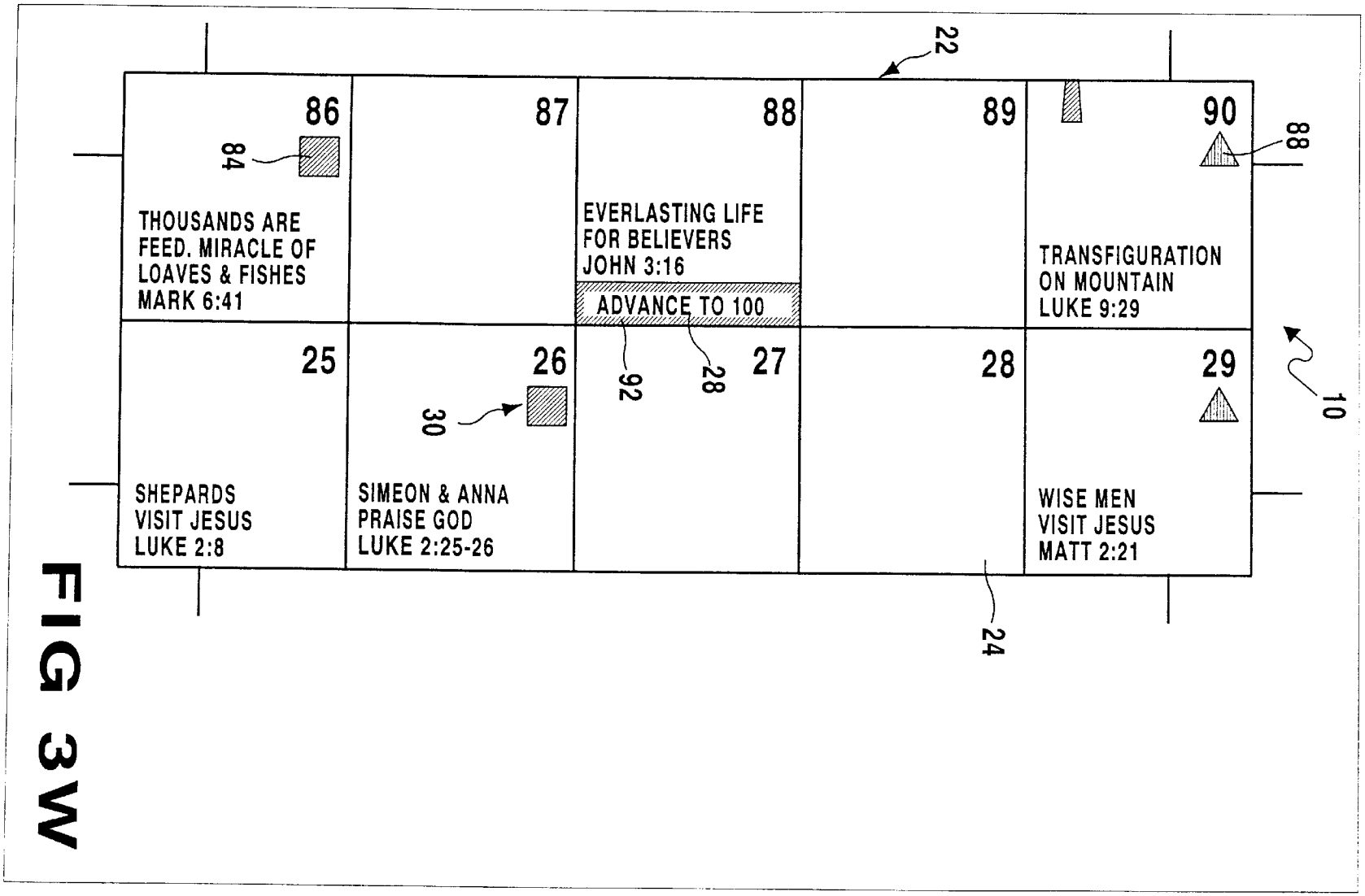
Figure 3X:
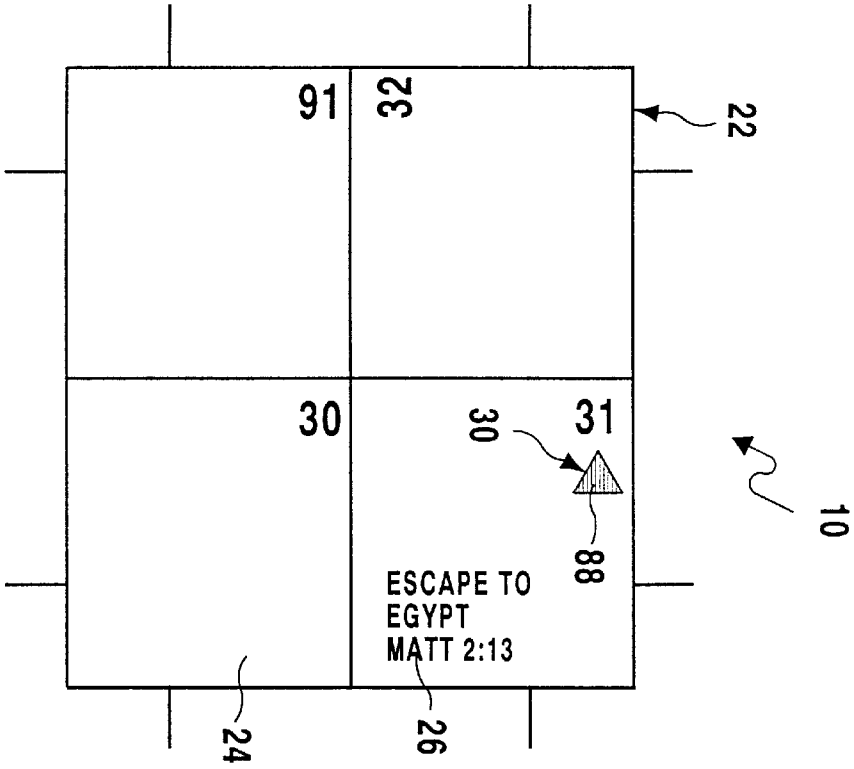

Turning now descriptively to the drawings, in which similar reference characters denote similar elements throughout the several views, FIGS. 1 through 4F illustrate the present invention being a bible game 10. With regard to the reference numerals used, the following numbering is used throughout the various drawing figures.

| | |
|---|---|
| 10 | bible game |
| 12 | old testament game board of 10 |
| 14 | numbered playing space of 12 |
| 14a | first numbered playing space "start" of 12 |
| 14b | last numbered playing space "promised land" of 12 |
| 16 | old testament information in 14 |
| 18 | instructions in 14 |
| 20 | symbol in 14 |
| 22 | new testament game board of 10 |
| 24 | numbered playing space of 22 |
| 24a | first numbered playing space "start" of 22 |
| 24b | last numbered playing space "golden city" of 22 |
| 26 | new testament information in 24 |
| 28 | instructions in 24 |
| 30 | symbol in 24 |
| 32 | player piece of 10 |
| 34 | chance determining means |
| 36 | angel card of 10 |
| 38 | archangel card of 10 |
| 40 | blessing card of 10 |
| 42 | penalty card of 10 |
| 44 | vision card of 10 |
| 46 | die of 34 |
| 48 | picture of angel on 36 |
| 50 | picture of an archangel on 38 |
| 52 | instructions on 40 |
| 54 | instructions on 42 |
| 56 | VC number on 62 |
| 58 | biblical picture on 62 |
| 60 | instructions on 62 |
| 62 | front face of 44 |
| 64 | short description on 68 |

-continued

| | |
|---|---|
| 66 | question on 68 |
| 70 | small green circle for 20 |
| 72 | small green square for 20 |
| 74 | small red square for 20 |
| 76 | small blue triangle with a corresponding vision card number for 20 |
| 78 | green band over 18 |
| 80 | red band over 18 |
| 82 | small green circle for 30 |
| 84 | small green square for 30 |
| 86 | small red square for 30 |
| 88 | small blue triangle with a corresponding vision card number for 30 |
| 90 | small red sword (Satan) for 30 |
| 92 | green band over 28 |
| 94 | red band over 28 |

The bible game 10 comprises an old testament game board 12 having a plurality of consecutive numbered playing spaces 14, in which a majority of the numbered playing spaces 14 bear old testament information 16, instructions 18 and different types of symbols 20. A new testament game board 22 is provided, having a plurality of consecutive numbered playing spaces 24, in which a majority of the numbered playing spaces bear new testament information 26, instructions 28 and different types of symbols 30. A plurality of player pieces 32 is also provided, with one for each of the game players. The player pieces 32 are of a size to fit within each of the numbered playing spaces 14 of the old testament game board 16, and the numbered playing spaces 24 of the new testament game board 22.

A change determining means 34 is for producing a random output count in positive integers. Each integer is a number in a base seven system to represent a direction of movement of each player piece 32 along the numbered playing spaces 14 on the old testament game board 12, and the numbered playing spaces 24 on the new testament game board 22. A plurality of angel cards 36 are used in the play of the game. A plurality of archangel cards 38 are used in the play of the game. A plurality of blessing cards 40 are used in the play of the game. The blessing cards 40 are coded to some of the symbols 20 on the old testament game board 12 and some of the symbols 30 on the new testament game board 22. A plurality of penalty cards 42 are used in the play of the game. The penalty cards 42 are coded to some of the symbols 20 on the old testament game board 12 and some of the symbols 30 on the new testament game board 22. A plurality of vision cards 44 are used in the play of the game. The vision cards 44 are coded to some of the symbols 20 on the old testament game board 12 and some of the symbols 30 on the new testament game board 22.

The old testament game board 12 is square. The consecutive numbered playing spaces 14 are position upon the old testament game board 12 to go form the first numbered playing space 14*a* labeled "start" near a corner in the counterclockwise direction, to the last numbered playing space 14*b* labeled "promised land" at the center of the old testament game board 12 in a generally spiraling manner.

The new testament game board 22 is also square. The consecutive numbered playing spaces 24 are positioned upon the new testament game board 22 to go from a first numbered playing space 24*a* labeled "start" near a corner in the counterclockwise direction, to the last numbered playing space 24*b* labeled "golden city" at the center of the new testament game board 22 in a generally spiraling manner.

Each of the player pieces 32 are of a different color from each other. The chance determining means 34 consists of a standard pair of dice 46. Each of the angel cards 36, as shown in FIG. 4A, has a picture of an angel 48 thereupon. Each of the archangel cards 38, as shown in FIG. 4C, has a picture of an archangel 50 thereupon.

Figure 4B:
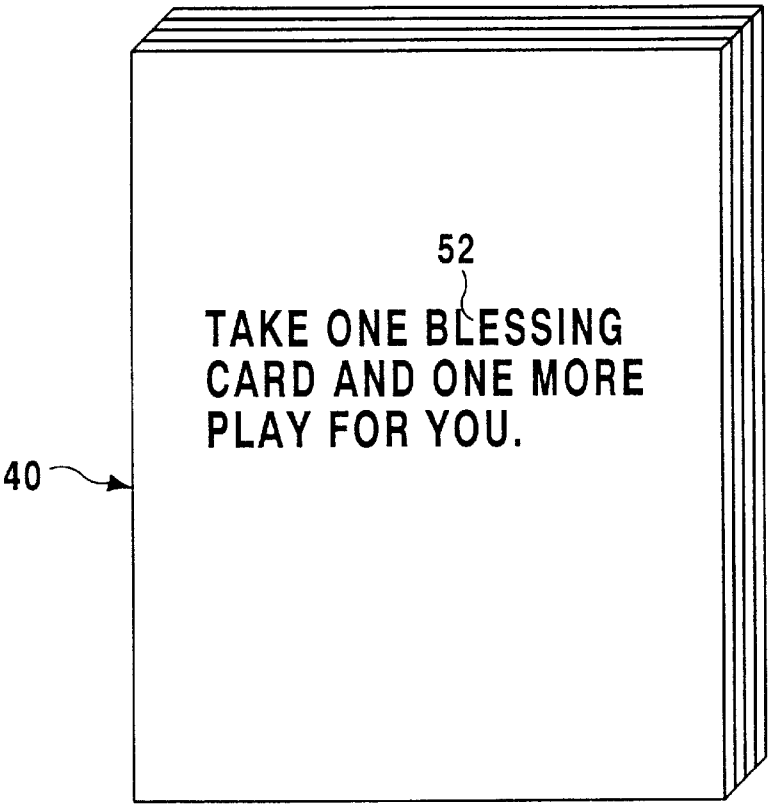
FIG. 4B is an enlarged plan view of the pack of blessing cards in FIG. 1.
Figure 4A:
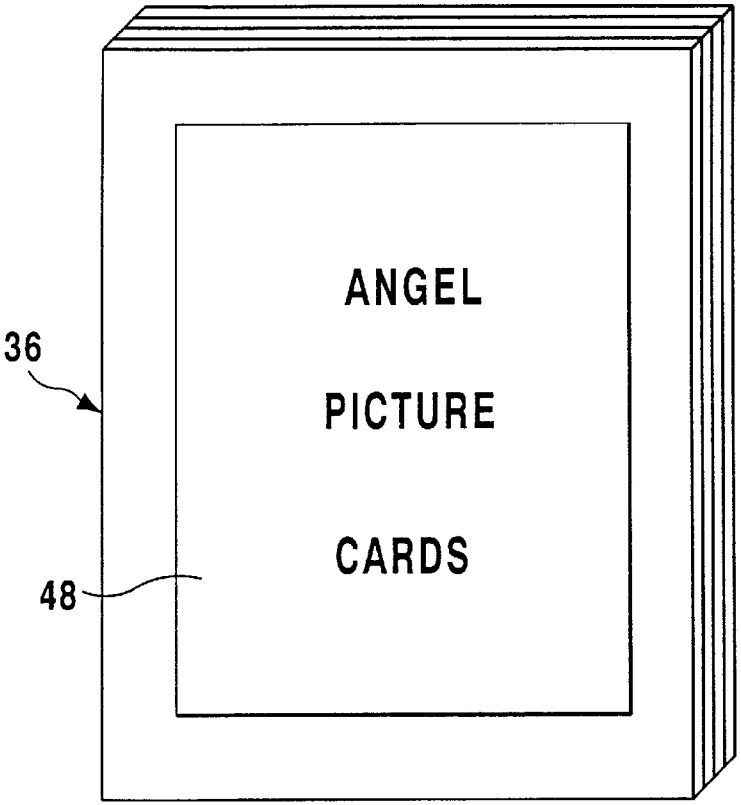
FIG. 4A is an enlarged plan view of the pack of angel cards in FIG. 1.
Figure 4D:
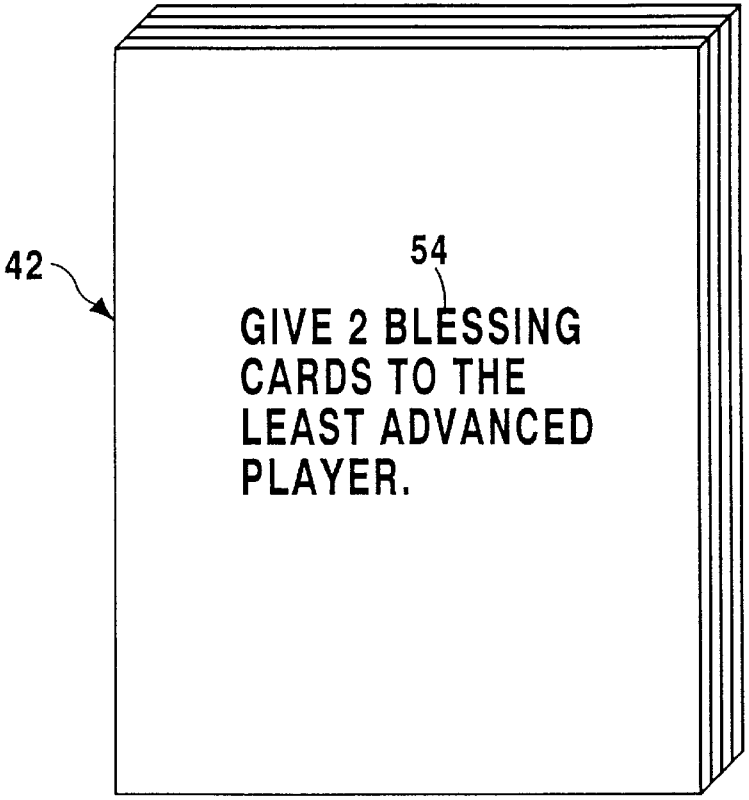
FIG. 4D is an enlarged plan view of the pack of penalty cards in FIG. 1.
Figure 4C:
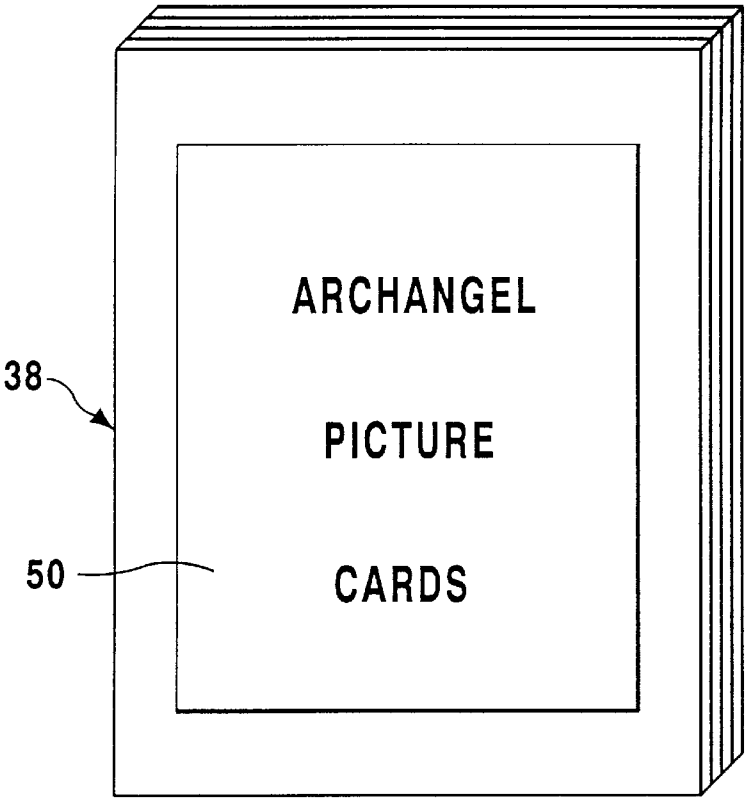
FIG. 4C is an enlarged plan view of the pack of archangel cards in FIG. 1.
Figure 4F:
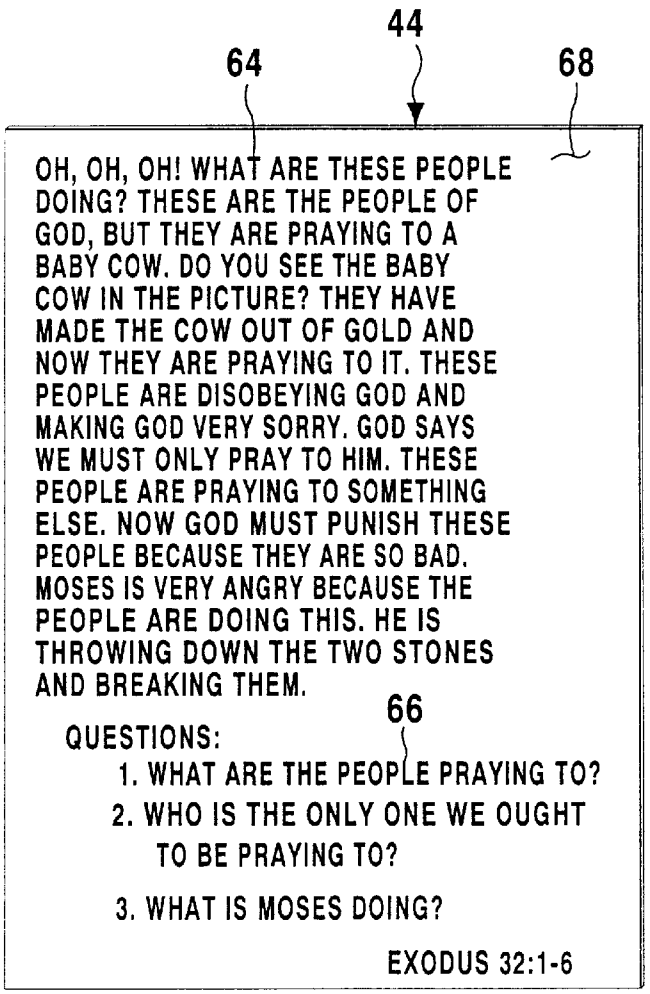
FIG. 4F is a rear view of one of the vision cards, as indicated by arrow 4F in FIG. 4E.
Figure 4E:
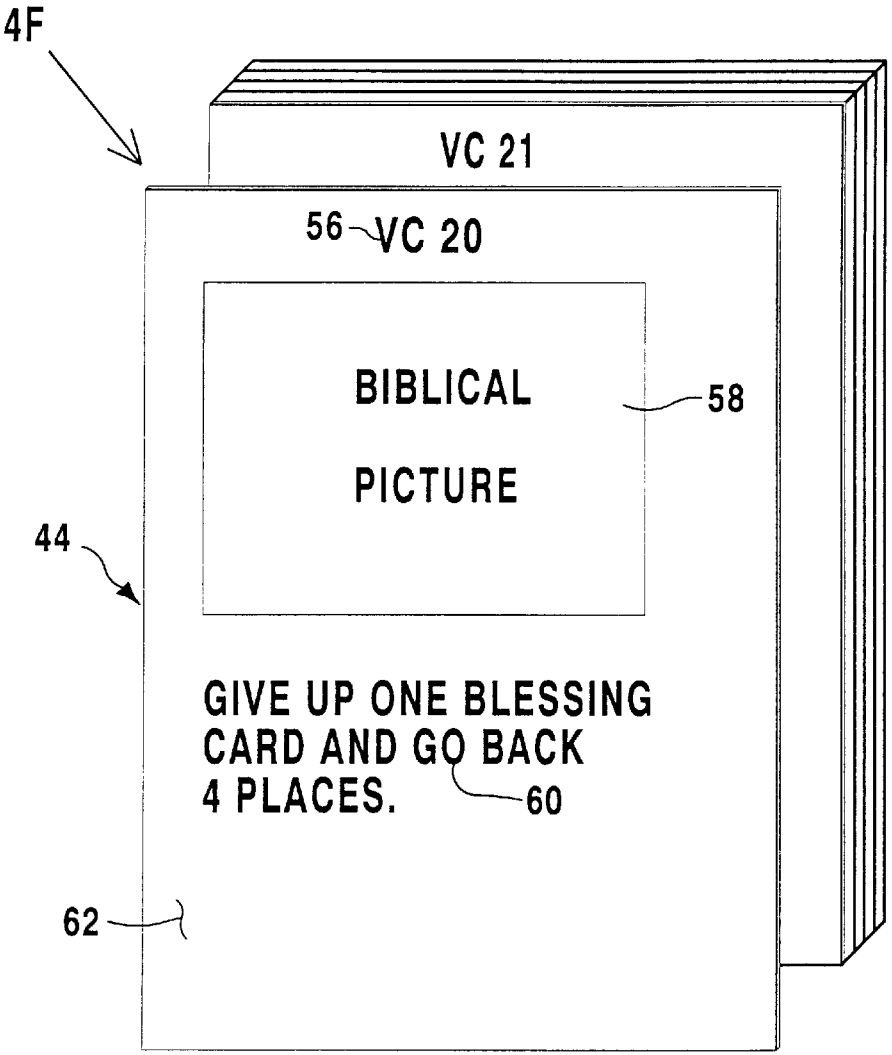
FIG. 4E is an enlarged plan view of the pack of vision cards in FIG. 1.

Each of the blessing cards 40, as shown in FIG. 4B, contains instructions 52 thereon indicating that a player is progressing. Each of the penalty cards 42, as shown in FIG. 4D, includes instructions 54 thereon indicating that a player has received a setback. Each of the vision cards 44, as shown in FIGS. 4E and 4F, contains a VC number 56, a biblical picture 58 and instructions 60 on a front face 62. A short description 64 about the biblical picture 58 and questions 66 about the short description 64 are on a rear face 68.

The old testament game board 12 further includes some of the symbols 20 being a small green circle 70, which indicates that a player must give away one of the blessing cards 40. Some of the symbols 20 are a small green square 72, which indicates that a player must pick one of the blessing cards 40. Some of the symbols 20 are a small red square 74, which indicates that a player must pick one of the penalty cards 42. Some of the symbols 20 are a small blue triangle with a corresponding vision card number 76, which indicates that a player must pick that particular vision card 44. Some of the instructions 18 are in a green band 78, to indicate a blessing and a forward movement for a player. Some of the instructions 18 are in a red band 80, to indicate a penalty and a rearward movement for a player.

The new testament game board 22 further contains some of the symbols 30 being a small green circle 82, which indicates that a player must give away one of the blessing cards 40. Some of the symbols 30 are a small green square 84, which indicates that a player must pick one of the blessing cards 40. Some of the symbols 30 are a small red square 86, which indicates that a player must pick one of the penalty cards 42. Some of the symbols 30 are a small blue triangle with a corresponding vision card number 88, which indicates that a player must pick that particular vision card 44. Some of the symbols 30 are a small red sword 90, which indicates that a player is a captive of Satan. Some of the instructions 28 are in a green band 92, to indicate a blessing and a forward movement for a player. Some of the instructions 28 are in a red band 94, to indicate a penalty and a rearward movement for a player.

RULES OF THE GAME

Start

To begin, each player places his/her player piece at the first numbered playing space called "start".

Each player receives four cards comprising of three angel cards and one archangel card.

Powers of Angel and Archangel Cards

An angel card can cancel only one penalty. When used, the angel card must be returned to the angel card pack. An archangel card has the power to cancel any penalty or set of penalties and is equivalent to three angel cards.

Archangel and Angel Cards

A player who has run out of angel cards may use the archangel card to cancel out a penalty or set of penalties. However, the player must return the archangel card to the archangel pack. If the player only cancels out one penalty, the archangel card must be returned to the archangel pack and the player collects two angel cards. If two penalties are canceled, the player collects only one angel card. If the player cancels out a set of three penalties, the archangel card is returned to the archangel pack and no angel cards are collected. No player is allowed to have more than one archangel card at any given time.

A player who has used his/her archangel card is entitled to reclaim or recover an archangel card if he/she receives a special blessing. In addition, the player also collects the angel card.

When a player piece lands on a numbered playing space with a small green circle at the lower half of the numbered playing space, the player must give a blessing card to the least advanced player.

Blessing and Penalty Cards

The location of a green square at the top right hand corner on a numbered playing space indicates that a blessing card must be taken from the blessing card pack and the instructions followed. Location of a red square indicates that a penalty card must be taken from the penalty card pack.

The instructions on a penalty card must be followed except where a player chooses to cancel out the instructions through use of an angel or archangel card(s).

Green or Red Bands in a Numbered Playing Space

When a player piece lands on a numbered playing space with a green or red band, the player must follow the instructions on that numbered playing space. However, the player may choose to cancel out penalty instructions through use of his/her angel/archangel cards.

Blue Triangles

When a player piece lands on a numbered playing space with a blue triangle the player must select the vision card with the corresponding number and follow the instructions on the vision card. However, the player may choose to cancel out penalty instructions through the use of angel/archangel cards.

A player, who in the process of following the instructions of a penalty card or in a red band lands his/her player piece in a numbered playing space with a small green square for a blessing card, cannot benefit from that blessing. Similarly, a player who lands his/her player piece on a numbered playing space with a small red square for a penalty card after receiving a blessing cannot be penalized, but the player can benefit a second time if the landing of his/her playing piece is on a numbered playing space with a small green square for a blessing card. A player who lands his/her playing piece on a numbered playing space with a red square after receiving a penalty cannot be penalized a second time.

Red Sword (New Testament)

A player who lands his/her playing piece on a numbered playing space with a red sword is determined to be a captive of Satan and can only escape if he/she scores three successive doubles with the dice, or uses an archangel card to do so. (The player must return the archangel card to the archangel pack).

A player who lands his/her player piece on one numbered playing space before a numbered playing space with a red sword is determined to be obstructed by Satan and must score two successive doubles with the dice or use two angel cards to cross over.

Loss of all Angel and Archangel Cards

A player who loses all his/her angel/archangel cards during the course of the game has an opportunity to recover these cards (redemption) if he/she scores a double with the dice. The first double scored entitles the player to receive on archangel card. If the player scores a second successive double with the dice, this entitles him/her to three additional angel cards, at which point the player's turn is ended and the next player continues the game. The player must also be allowed to reap the benefits of any blessings that may occur then.

However, if the player scores only one double with the dice, he/she must be allowed to proceed with the game as normal.

A player who loses all his/her angel/archangel cards for the first time is temporarily absolved from incurring penalties until he/she has been redeemed.

A player who loses all his/her angel/archangel cards a second time during the course of the game may only be redeemed on the following conditions:

a) If the other player (if only two players) agrees to a redemption.

b) If the player scores three doubles with the dice in succession.

c) If the majority of players (if three or more players) agree to a redemption.

If none of the above conditions is met, the player must leave the game.

A player who loses all his angel/archangel cards a third time during the course of the game automatically forfeits all opportunity for redemption and must leave the game.

Least Advanced Player

If two or more player pieces are at the same numbered playing space, the least advanced player is considered to be the player with the least number of blessing cards at the time. If the players have an equal number of blessing cards, then each player must cast the dice once. The player with the smallest score is considered to be the least advanced. If two or more players have the same score, then these players must be allowed to cast the dice again. Should the scores be equal, the player who scores first is considered to be the least advanced player.

Winner

The first player to have his/her player piece arrive at the last numbered playing space in the center being the "promised land" or "golden city", is the overall winner of the game. However, the remaining players (if two or more players remain), may choose to continue the game in order to decide on the second, third or fourth place winners, as the case may be.

A player who has his/her player piece two or more numbered playing spaces away from winning, must score with a roll of the dice the exact number of points required for advancing to the last numbered playing space. Example, if a player is at two hundred eighty one, he/she must score exactly six points to win. If the player scores a double with the dice that is more than the number of points required to win, he/she must be allowed to roll the dice again.

The winners of the game (first, second, third place, etc.) must divide their angel cards equally among the remaining players. Any extra angel card or cards must go to the least advanced player.

A player who is only one numbered playing space away from winning (i.e. at number two hundred eighty six) can advance to the last numbered playing space by doing one of three things:

1) Scoring a double with the dice;

2) Using three blessing cards to advance to number two hundred eighty seven, being the last numbered playing space;

3) Using an archangel card to advance to number two hundred eighty seven.

To start the game, each player is allowed one roll of the dice. The player with the highest score starts the game and rolls the dice or spins the wheel again. From then on, the other players taking a turn to roll the dice, will go in a clockwise direction from player number one. The player pieces are moved in an counterclockwise direction in the direction of the arrow from the first numbered playing space "start".

Assuming that there are four players, the game should proceed as follows:

1) Player Number One—Rolls the dice and moves his/her player piece the same amount of numbered playing spaces as his/her score determines. Example, if the score is five the player piece is moved from one to five numbered playing spaces on the old testament/new testament game board.

2) Player Number Two—If his/her score is ten, the player piece is placed at numbered playing space number ten. The player must then draw a penalty card and follow the instructions on the penalty card. The instructions must be read aloud and can be verified by one or more players. The player may choose to cancel the penalty or set of penalties, as the case may be, by use of his angel or archangel cards. The penalty card is then returned to the bottom of the penalty card pack.

3) Player Number Three—If he/she scores seven, the player piece is moved to numbered playing space number seven. This player may choose to cancel the penalty on this numbered playing space (miss one play). However, if he/she chooses not to cancel, he/she must miss his/her turn in the next round and the play goes to the next player.

4) Player Number Four—If he/she scores twelve (a double), the player piece is advanced to numbered playing space number twelve and because of the double, the player rolls the dice a second time. Assuming that the player scores ten in the second roll (six and four), the player advances his/her player piece ten numbered playing spaces from numbered playing space number twelve to numbered playing space number twenty-two. At number twenty-two, the player refers to vision card two (VC2) in the vision card deck and follows the instructions on that vision card.

5) The play then returns to player number one and the game proceeds.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A bible game comprising:

a) an old testament game board having a plurality of consecutive numbered playing spaces, in which a majority of said numbered playing spaces bear old testament information, instructions and different types of symbols;

b) a new testament game board having a plurality of consecutive numbered playing spaces, in which a majority of said numbered playing spaces bear new testament information, instructions and different types of symbols;

c) a plurality of player pieces, one for each of the game players, said player pieces being of a size to fit within each of said numbered playing spaces of said old testament game board and said numbered playing spaces of said new testament game board;

d) chance determining means for producing a random output count in positive integers, each integer being a number in a base seven system to represent a direction of movement of each said playing piece along said numbered playing spaces on said old testament game board and said numbered playing spaces on said new testament game board;

e) a plurality of angel cards used in the play of the game;

f) a plurality of archangel cards used in the play of the game;

g) a plurality of blessing cards used in the play of the game, said blessing cards are coded to some of said symbols on said old testament game board and some of said symbols on said new testament game board;

h) a plurality of penalty cards used in the play of the game, said penalty cards are coded to some of said symbols on said old testament game board and some of said symbols on said new testament game board; and i) a plurality of vision cards used in the play of the game, each of said vision cards having a unique VC number to distinguish each vision card, each vision card also includes a biblical picture and instructions on a front face, a short description about the biblical picture and questions about the short description on a rear face, some of said playing spaces, on said old testament game board and on said new testament game board, bearing symbols coded to said vision cards, each of these vision card coded playing spaces also having a VC number identifying a specific vision card, wherein each of said vision card coded playing spaces identifying a different vision card.

2. A bible game as recited in claim 1, wherein said old testament game board is square, while said consecutive numbered playing spaces are positioned upon said old testament game board to go from said first numbered playing space labeled "start" near a corner in a counterclockwise direction, to said last numbered playing space labeled "promised land" at the center of said old testament game board in a generally spiraling manner.

3. A bible game as recited in claim 1, wherein said new testament game board is square, while said consecutive numbered playing spaces are positioned upon said new testament game board to go from a first numbered playing space labeled "start" near a corner in a counterclockwise direction, to said last numbered playing space labeled "golden city" at the center of said new testament game board in a generally spiraling manner.

4. A bible game as recited in claim 1, wherein each of said player pieces are of a different color from each other.

5. A bible game as recited in claim 1, wherein said chance determining means includes a standard pair of dice.

6. A bible game as recited in claim 1, wherein each of said angel cards includes a picture of an angel thereupon.

7. A bible game as recited in claim 1, wherein each of said archangel cards includes a picture of an archangel thereupon.

8. A bible game as recited in claim 1, wherein each of said blessing cards includes instructions thereon indicating that a player is progressing.

9. A bible game as recited in claim 1, wherein each of said penalty cards includes instructions thereon indicating that a player has received a setback.

10. A bible game as recited in claim 1, wherein said old testament game board further includes:

a) some of said symbols being a small green circle, which indicates that a player must give away one of said blessing cards;

b) some of said symbols being a small green square, which indicates that a player must pick one of said blessing cards;

c) some of said symbols being a small red square, which indicates that a player must pick one of said penalty cards;

d) some of said symbols being a small blue triangle with a corresponding vision card number, which indicates that a player must pick that particular said vision card;

e) some of said instructions being in a green band, to indicate a blessing and a forward movement for a player; and f) some of said instructions being in a red band, to indicate a penalty and a rearward movement for a player.

11. A bible game as recited in claim 1, wherein said new testament game board further includes:

a) some of said symbols being a small green circle, which indicates that a player must give away one of said blessing cards;

b) some of said symbols being a small green square, which indicates that a player must pick one of said blessing cards;

c) some of said symbols being a small red square, which indicates that a player must pick one of said penalty cards;

d) some of said symbols being a small blue triangle with a corresponding vision card number, which indicates that a player must pick that particular said vision card;

e) some of said symbols being a small red sword which indicates that a player is a captive of Satan;

f) some of said instructions being in a green band, to indicate a blessing and a forward movement for a player; and g) some of said instructions being in a red band, to indicate a penalty and a rearward movement for a player.

12. A bible game comprising:

a) an old testament game board having a plurality of consecutive numbered playing spaces, in which a majority of said numbered playing spaces bear old testament information, instructions and different types of symbols, wherein said old testament game board is square, while said consecutive numbered playing spaces are positioned upon said old testament game board to go from said first numbered playing space labeled "start" near a corner in a counterclockwise direction, to said last numbered playing space labeled "promised land" at the center of said old testament game board in a generally spiraling manner;

b) a new testament game board having a plurality of consecutive numbered playing spaces, in which a majority of said numbered playing spaces bear new testament information, instructions and different types of symbols, wherein said new testament game board is square, while said consecutive numbered playing spaces are positioned upon said new testament game board to go from a first numbered playing space labeled "start" near a corner in a counterclockwise direction, to said last numbered playing space labeled "golden city" at the center of said new testament game board in a generally spiraling manner;

c) a plurality of player pieces, one for each of the game players, said player pieces being of a size to fit within each of said numbered playing spaces of said old testament game board and said numbered playing spaces of said new testament game board;

d) chance determining means for producing a random output count in positive integers, each integer being a number in a base seven system to represent a direction of movement of each said playing piece along said numbered playing spaces on said old testament game board and said numbered playing spaces on said new testament game board;

e) a plurality of angel cards used in the play of the game;

f) a plurality of archangel cards used in the play of the game;

g) a plurality of blessing cards used in the play of the game, said blessing cards are coded to some of said symbols on said old testament game board and some of said symbols on said new testament game board;

h) a plurality of penalty cards used in the play of the game, said penalty cards are coded to some of said symbols on said old testament game board and some of said symbols on said new testament game board; and i) a plurality of vision cards used in the play of the game, each of said vision cards having a unique VC number to distinguish each vision card, each vision card also includes a biblical picture and instructions on a front face, a short description about the biblical picture and questions about the short description on a rear face, some of said playing spaces, on said old testament game board and on said new testament game board, bearing symbols coded to said vision cards, each of these vision card coded playing spaces also having a VC number identifying a specific vision card, wherein each of said vision card coded playing spaces identifying a different vision card.

13. A bible game as recited in claim 12, wherein each of said player pieces are of a different color from each other.

14. A bible game as recited in claim 13, wherein said chance determining means includes a standard pair of dice.

15. A bible game as recited in claim 14, wherein each of said angel cards includes a picture of an angel thereupon.

16. A bible game as recited in claim 15, wherein each of said archangel cards includes a picture of an archangel thereupon.

17. A bible game as recited in claim 16, wherein each of said blessing cards includes instructions thereon indicating that a player is progressing.

18. A bible game as recited in claim 17, wherein each of said penalty cards includes instructions thereon indicating that a player has received a setback.

19. A bible game as recited in claim 18, wherein said old testament game board further includes:

a) some of said symbols being a small green circle, which indicates that a player must give away one of said blessing cards;

b) some of said symbols being a small green square, which indicates that a player must pick one of said blessing cards;

c) some of said symbols being a small red square, which indicates that a player must pick one of said penalty cards;

d) some of said symbols being a small blue triangle with a corresponding vision card number, which indicates that a player must pick that particular said vision card;

e) some of said instructions being in a green band, to indicate a blessing and a forward movement for a player; and f) some of said instructions being in a red band, to indicate a penalty and a rearward movement for a player.

20. A bible game as recited in claim 19, wherein said new testament game board further includes:

a) some of said symbols being a small green circle, which indicates that a player must give away one of said blessing cards;

b) some of said symbols being a small green square, which indicates that a player must pick one of said blessing cards;

c) some of said symbols being a small red square, which indicates that a player must pick one of said penalty cards;

d) some of said symbols being a small blue triangle with a corresponding vision card number, which indicates that a player must pick that particular said vision card;

e) some of said symbols being a small red sword which indicates that a player is a captive of Satan;

f) some of said instructions being in a green band, to indicate a blessing and a forward movement for a player; and g) some of said instructions being in a red band, to indicate a penalty and a rearward movement for a player.

* * * * *